US007380694B2

(12) United States Patent
Ueno

(10) Patent No.: US 7,380,694 B2
(45) Date of Patent: Jun. 3, 2008

(54) ATTACHMENT TO BE USED FOR AN APPARATUS FOR ATTACHING A TAG-ATTACHING PIN

(75) Inventor: Hideyuki Ueno, Kanagawa (JP)

(73) Assignee: Kotec's Co., Ltd., Tokyo (JP)

( * ) Notice: Subject to any disclaimer, the term of this patent is extended or adjusted under 35 U.S.C. 154(b) by 133 days.

(21) Appl. No.: 11/272,117

(22) Filed: Nov. 10, 2005

(65) Prior Publication Data

US 2006/0113349 A1 Jun. 1, 2006

(30) Foreign Application Priority Data

Nov. 12, 2004 (JP) ..... 2004-328414
Apr. 7, 2005 (JP) ..... 2005-110796

(51) Int. Cl.
*B25C 1/00* (2006.01)

(52) U.S. Cl. ..... 227/67; 227/68; 227/66

(58) Field of Classification Search ..... 227/67, 227/68, 66, 77
See application file for complete search history.

(56) References Cited

U.S. PATENT DOCUMENTS 2,729,177 A * 1/1956 Flood ..... 112/104
3,103,666 A * 9/1963 Bone ..... 227/67
3,650,452 A * 3/1972 Finke ..... 227/67
3,659,769 A * 5/1972 Bone ..... 227/68
3,759,435 A * 9/1973 Bone ..... 227/67
3,924,788 A * 12/1975 Furutu ..... 227/67
4,049,179 A * 9/1977 Jenkins ..... 227/67
4,121,487 A * 10/1978 Bone ..... 83/23
4,288,017 A * 9/1981 Russell ..... 227/67
4,310,962 A * 1/1982 Suzuki ..... 29/417
4,492,330 A 1/1985 Furutsu
4,971,238 A * 11/1990 Furutsu ..... 227/2
5,024,365 A * 6/1991 Bourque ..... 227/67
5,033,664 A * 7/1991 Bone et al. ..... 227/67
5,405,070 A * 4/1995 Kunreuther ..... 227/67
5,501,002 A * 3/1996 Fukami ..... 29/811.2

(Continued)

FOREIGN PATENT DOCUMENTS

EP 0 350 545 1/1990

(Continued)

*Primary Examiner*—Brian D Nash
(74) *Attorney, Agent, or Firm*—Greer, Burns & Crain, Ltd.

(57) ABSTRACT

An attachment used for an apparatus for attaching a tag-attaching pin utilizing a sheet of tag-attaching pins in which a plurality of tag-attaching pins is provided. Each pin has a filament section, an inserting head section provided at one end of the filament section, and a socket section or a holding section provided at the another end of the filament section. The pins are mutually arranged in parallel configuration and at least the inserting head section, the socket section, or the holding section are connected to connecting bars. The attachment is provided with a connecting portion detachably coupled with a coupling means formed on a side wall surface of the apparatus and a tag attaching pin controlling means, which is provided on the side wall surface of the apparatus and extends upward from a top surface of the apparatus. A connecting bar controlling means can control an arranged locus configuration of the connecting bars of the sheet and is formed on at least a portion of the tag attaching pin controlling means.

4 Claims, 21 Drawing Sheets

U.S. PATENT DOCUMENTS

| | | | | | |
|---|---|---|---|---|---|
| 5,826,775 | A * | 10/1998 | Mooney et al. | 227/67 | |
| 5,878,935 | A * | 3/1999 | Furutsu | 227/67 | |
| 6,126,056 | A | 10/2000 | Ueno et al. | | |
| 2003/0094476 | A1 | 5/2003 | Furutsu et al. | | |

FOREIGN PATENT DOCUMENTS

| | | |
|---|---|---|
| EP | 0 825 120 | 2/1998 |
| EP | 0 915 449 | 5/1999 |

* cited by examiner (A)

(B)

(C)

(A)

(B)

(A)

(B)

(A)

(B)

(A)

(B)

(A)

(B)

(A)

(B)

ATTACHMENT TO BE USED FOR AN APPARATUS FOR ATTACHING A TAG-ATTACHING PIN

FIELD OF THE INVENTION

The present invention relates to a tag attaching device which can shoot a pin that can bind clothes, socks, or the like or which can attach tags such as brand labels, price tags, material description, instructions or the like to a good by inserting one end portion of the pin into the good.

BACKGROUND OF THE INVENTION

In general, in order to bind clothes, daily small articles, sandals, shoes or the like or to efficiently attach brand labels, price tags or the like to relevant products, various kinds of tag attaching device have been used in the past.

One embodiment of a specific configuration of a conventional tag attaching pin is shown in FIG. 7.

As shown in FIG. 7, the tag attaching pin 1 comprises a desired filament section 4, an insertion head section 2 provided at one end portion of the filament section 4 and a holding section 3 provided at the another end of the filament section 4 and which can hold a tag 5 thereon, and the tag attaching pin 1 is made of a suitable synthetic resin material and all of the above-mentioned sections are integrally molded into one body.

As shown in FIG. 8, first, the filament section 4 of the tag attaching pin 1 is inserted into a hole 6 which had been previously provided in the tag 5 and then the insertion head section 2 of the tag attaching pin 1 with the tag 5 held thereon, is penetrated through a desired portion of a desired good 100 so that the tag attaching pin 1 is engaged with the good 100.

On the other hand, a separate embodiment of the tag attaching pin 10 used in the past will be explained hereunder with reference to FIG. 9.

A tag attaching pin 10 as shown in FIG. 9, comprises a flexible filament section 12, an insertion head section 13 equipped with a suitable engagement section 16 located at one end of the filament section 12, and a socket section 15 equipped with a hole 14 for irreversibly passing the insertion head section 13 located at the other end of the filament section 12, wherein the hole 14 being provided with a pair of blade section 17, 17 inside thereof and which can engage with the engagement section 16 of the insertion head section 13.

And further, as similar to the above mentioned previous embodiment, this conventional tag attaching pin 1 and 10, for example, is made of a synthetic resin material such as nylon resin, polyester resin or the like and also the insertion head section 13, the socket section or the holding section 15 and the filament section 12 thereof being integrally molded into one body.

In the above-mentioned embodiment, as shown in FIG. 10, when a desired good, for example a bag 200, is a target good to which a tag should be attached, after the filament section 12 is inserted into a hole 410 previously provided on the tag 400, such as a label or the like, the socket section 15 and a part of the filament section 12, for example, are passed through a space formed between a gripping portion 300 of the bag and a surface of the main body of the bag 200 and then the insertion head section 13 is inserted into the hole 14 formed inside the socket section 15 which causes a hole in the tag, so that a predetermined tag 400 can be attached to the good 200 and reduce the filament section 12 into a loop-like configuration.

On the other hand, for example, as shown in FIG. 11, a tag attaching device 20 which is generally called a pin shooting gun, is known whereby the above-mentioned tag attaching pin 1 or 10 can be attached to a good 100. The tag attaching device 20 comprises a hollow needle 21 to be penetrated through a desired good so as to engage the insertion head section 2 of the tag attaching pin 1 with a back side surface of the good. By operating a suitable lever 22, the insertion head section 2 is inserted into the hollow needle 21 and then the insertion head section 2 is pushed out from the hollow needle 21 utilizing a suitable pin pushing-out means so as to have the insertion head section 2 of the tag attaching pin engaged with the good.

In this embodiment, it is preferable that the unit of tag attaching pin 1 can be shot out from the tag attaching device 20 one by one or it is also preferable that as shown in FIG. 12, a plurality of the units of tag attaching pin 1 are arranged in parallel with each other and they are simultaneously connected to a suitable connecting member such as a runner bar 24 via a respective suitable connecting member 11. As shown in FIG. 12, the integrated assembled tag attaching pins are inserted into an insertion portion 41 provided on a top end surface of the tag attaching device 20 as shown in FIG. 11, so as to enable each one of the tag attaching pins 1 to be successively shot individually into a predetermined good, respectively so that a tag can be attached to the good.

Further, as a separate conventional embodiment related to the above-mentioned apparatus for attaching a tag-attaching pin, an apparatus for attaching a tag-attaching pin which uses a sheet of tag-attaching pins as shown in FIG. 13 in which a plurality of tag-attaching pins as shown in FIG. 9, are arranged in parallel configuration to each other. The parallel configuration thereof is kept fixed by using a pair of connecting bars to which each one of the tag-attaching pins are connected to the connecting bar, respectively.

Note that, in using a tag-attaching pin 10 having such a configuration as mentioned-above, it can also be used individually, but in many cases, in order to improve work efficiency, a plurality of loop pins 10 are arranged in a parallel configuration to form a sheet of tag-attaching pins 600 such as shown, for example, in FIG. 13.

Specifically, the structure of the loop pin sheet 600 is such that the individual loop pins 10 shown in FIG. 9 are provided so as to be mutually parallel and neighboring, and are caused to be connected to the connecting bars 24, 24' provided individually at or in the region of the plurality of insertion head portions 13 and at or in the vicinity of the plurality of socket portions 15, there further being a mutual linkage between the vicinity of the insertion head portions and the vicinity of the socket portions by means of the connection links 11, 11', as shown in FIG. 13.

The above-noted sheet of tag-attaching pins 600, similar to loop pins of the past, is normally formed integrally as one from, for example, synthetic resins such as nylon, polypropylene, polyester or the like.

The sheet of tag-attaching pins 600 can be mounted on an apparatus for attaching a tag-attaching pin 20 as shown in FIG. 14, and each time the operation lever 22 of the apparatus is operated, each one of the tag-attaching pins 10 is shot out so as to attach a label or the like to a product.

FIG. 14 shows a condition in which the sheet of tag-attaching pins 600 is mounted on the apparatus for attaching a tag-attaching pin 20 in which the sheet of tag-attaching pins is bent so as to form an U-type configuration.

FIG. 15 is an upper plan view of the apparatus for attaching a tag-attaching pin 20 as used in the conventional embodiment, in which a pair of vertical grooves 40, 41 are formed at a right had side portion and at a left hand side portion thereof into which connecting bars 24, 24' of the sheet of tag-attaching pins 600 are inserted, respectively.

For example, the connecting bar 24' linking the socket portions 15 of the sheet of tag-attaching pins 600 is inserted into the vertical groove 40, while the connecting bar 24 linking the insertion head portions 13 thereof is inserted into the vertical groove 41. The apparatus for attaching a tag-attaching pin 20 is provided with an out-pushing pin 42 at a position in the vicinity of the vertical groove 41 and which is driven by operation of the operation lever 22 as shown in FIG. 14, so as to cause a separation of the insertion head portion 13 from the connection link 11 of the connecting bar 24, thereby pushing out the same forward along the hollow tubular pin 21, one at a time.

On the other hand, the socket portion 15 is pushed outward along the guide member 43 formed as a curved hollow guide member, by an appropriate out-pushing means, for example, by an out-pushing means 25 that is an out-pushing pin or a gear-rack system, so that it mates with the insertion head portion 13 that is pushed outward by the out-pushing pin 42 via a hollow guide formed by a hollow pin 21 at the front portion of the apparatus.

Further, the inventor of the present invention, has proposed a new apparatus for attaching a tag-attaching pin 20 as shown in FIG. 16, in order to improve the conventional apparatus for attaching a tag-attaching pin as shown in FIG. 14.

Note that, in the apparatus for attaching a tag-attaching pin 20 as shown in FIG. 16, although it uses the same mechanism and is substantially identical to that of the apparatus for attaching a tag-attaching pin 20 as shown in FIG. 14, and which also uses the sheet of tag-attaching pins 600 as shown in FIG. 13, in order to minimize a size of the apparatus for attaching a tag-attaching pin 20 and to effectively prevent a generation of jamming conditions. Jamming conditions occur because a plurality of adjacently arranged tag attaching pins are entangled with each other during the shooting operation for individual tag attaching pins and the problem causes the tag attaching pin shooting operation to be impossible. More specifically, the apparatus for attaching a tag-attaching pin 20 has a different configuration from those of other conventional embodiments in that, referring to FIG. 16, a part of a top upper surface of the apparatus 20, on which a vertical groove, that is an insertion slit 41 into which the connecting bar 24 to which a plurality of the inserting head sections 13 are connected, is inserted, is formed at a lower level in vertical direction comparing with the level of a part of the top surface of the apparatus 20, on which a vertical slit, that is an insertion slit 40 into which the connecting bar 24' to which a plurality of the socket sections 15 are connected, is inserted, is formed.

Accordingly, in this conventional embodiment, a width of the apparatus 20 can be remarkably shortened so that a minimized apparatus 20 can be realized.

However, in these conventional apparatus for attaching a tag-attaching pin, when the sheet of tag-attaching pins formed by a plurality of the tag-attaching pins are arranged in a parallel configuration to each other and each one of the tag-attaching pins is shot one by one so as to attach the respective pin to a desired good, a length of the sheet 600 becomes longer as the number of the pins is increased. Therefore, a problem arises in which the sheet of tag-attaching pins swings when an operator is working with the apparatus and the operator needs to shift his attention to this problem causing his working efficiency to be reduced.

And further, due to the swinging condition of the sheet 600, another problem that often arises is a jamming condition wherein a plurality of adjacently arranged tag attaching pins are entangled with each other during the shooting operation for individual tag attaching pins. This can result in a tag-attaching pin not being shot out at a time when it should be shot out and remaining inside the apparatus causing the apparatus to malfunction.

The longer the length of the sheet of tag-attaching pins becomes, the more significant this problem becomes.

In addition to these problems, in a case when it is necessary to insert a tag-attaching pin into a hole such as a button hole of a cloth or a bag, or an aperture of a metal member of a fastener or the like, utilizing the apparatus for attaching a tag-attaching pin in order to attach a predetermined label or the like to a cloth or bag or the like a plurality of which are concentrated together and arranged in a hanging down configuration utilizing a suitable hanger or the like, for example, it is apparent that the tag attaching operation should be done by bringing the apparatus into such concentrated and adjacently arranged clothes or bags so as to shoot out each one of the tag-attaching pins respectively, one by one.

However, in this situation, since the clothes or the bags abut to the sheet of tag-attaching pins or apply a pushing force to the sheet, a further problem arises in that the sheet is deformed or the sheet is dropped out from the apparatus.

Further, on the other hand, in a case in which with utilizing the sheet having a short length, the tag-attaching pin is attached to a desired good and arranged separate, therefore the above-mentioned problems do not arise. Thus, it becomes easier to operate when a suitable supporting member for the sheet of tag-attaching pins is always mounted on the apparatus.

In order to resolve such problems, in the past, for example, as shown in the Japanese Unexamined Patent Publication (KOKAI) No. 57-46728, a new technology is proposed in that a cover portion which can cover the uppermost surface of an apparatus for attaching a tag-attaching pin is provided, whereby a sheet of tag-attaching pins must be inserted into the cover portion in order to continually supply a long sheet of tag-attaching pins on the apparatus.

However, in this apparatus, an operation for inserting the sheet into the cover portion is complicated and time consuming and thus working efficiency is remarkably reduced when a long sheet is used, since a front end of the sheet of tag-attaching pins is projected far from a rear end portion of the apparatus, it becomes troublesome for an operator.

In addition, the Japanese Unexamined Patent Publication (KOKAI) No. 2000-85733 shows a technology in that a guide member which can control an arranged locus configuration of a sheet of tag-attaching pins, is rotatably mounted on an upper surface of the apparatus for attaching a tag-attaching pin.

However, in this technology, although both an insertion portion of the sheet and a connecting bar are partially covered by a guide member so that the arranged locus configuration of the sheet is controlled, under this technology, the insertion portion performs a sliding operation with the guide member. Thus, the arranged locus configuration of the insertion portion becomes different and when one of the tag-attaching pin is shot out, a separate problem arises in that the tag-attaching pin cannot be shot out.

Further, the guide member is permanently fixed to the apparatus for attaching a tag-attaching pin and thus a separate problem arises in that an application of the apparatus is strictly limited.

Accordingly, an object of the present invention is to resolve the above-mentioned problems as seen in the conventional technologies and to provide an attachment used for an apparatus for attaching a tag-attaching pin which makes the tag-attaching pin attaching operation easy especially when the apparatus is inserted into lots of goods that are closely arranged to each other and a tag-attaching pin should be attached to a predetermined portion of each one of the goods, as well as prevent a jamming condition caused by a plurality of tag-attaching pins or a sheet of tag-attaching pins being entangled with each other inside the apparatus, and further to provide an apparatus for attaching a tag-attaching pin provided with the attachment.

SUMMARY OF THE INVENTION

In order to achieve the above-noted object, the present invention has the following basic technical features.

Specifically, an attachment of the present invention is so configured that an attachment which can be used for an apparatus using a sheet of tag-attaching pins in which a plurality of tag-attaching pins, each comprising a filament section, an inserting head section provided at one end of the filament section, and a socket section or holding section provided at the another end of the filament section, are mutually arranged in parallel configuration and at least the inserting head section or a portion in the vicinity of the inserting head section and at least the socket section or holding section or a portion in the vicinity of the socket section or holding section of each one of the tag-attaching pins thereof, being connected to connecting bars so that the parallel configuration of the sheet of tag-attaching pins can be maintained, wherein the tag is attached to a desired good with the holding section by inserting the inserting head section of the tag-attaching pin into a hollow needle provided on the tag attaching device and by penetrating the inserting head section through the good with pushing the inserting head section out of the hollow needle utilizing a predetermined pin pushing means, so as to have the inserting section attached to a surface of the good with the tag or to have the inserting section engaged with the socket section of the tag-attaching pin with the tag via a part of the good so that the tag is kept by the filament section, wherein the attachment is provided with a connecting portion which can be detachably coupled with a coupling means formed on a side wall surface of the apparatus for attaching a tag-attaching pin and a tag attaching pin controlling means which is provided on the side wall surface of the an apparatus for attaching a tag-attaching pin and extending upwardly from a top surface of the an apparatus for attaching a tag-attaching pin, the coupling means and the tag attaching pin controlling means being integrally formed with each other, and further wherein a connecting bar controlling means which can control an arranged locus configuration of the connecting bars of the sheet of the tag-attaching pins is formed on at least a portion of the tag attaching pin controlling means.

Since the attachment of the present invention has the above-mentioned technical features, the attachment of the present invention can make a tag attaching pin attaching operation utilizing the apparatus for attaching a tag-attaching pin easy and can significantly improve a working efficiency.

For example, especially when the apparatus is inserted into lots of goods each being closely arranged to each other and a tag should be attached to a predetermined portion of each one of the goods utilizing the tag-attaching pin, since the attachment fixes and covers the sheet, when the apparatus is inserted into the predetermined group of goods so as to attach the tag-attaching pin to the good, the sheet is prevented from being hooked on the good and thus an interruption of the tag-attaching pin attaching operation is also effectively prevented from being generated.

Further, when the apparatus is inserted into a group of goods or when it is withdrawn therefrom, the operation to do so is not interrupted or at the same situation, the sheet is also prevented from being dropped out from the apparatus.

In addition, at the same situation, a generation of a jamming condition caused by a plurality of adjacently arranged filament sections of a sheet of tag-attaching pins being entangled with each other inside the apparatus is also effectively prevented.

Further, in the present invention, the attachment is so configured that it is detachably mounted on the apparatus for attaching a tag-attaching pin and thus in accordance with a shape or arranged configuration of an objected good to which an tag-attaching pin should be attached, the present invention has an effect in that the apparatus for attaching a tag-attaching pin can be used without the attachment and accordingly, an application area for the apparatus is enlarged.

BRIEF DESCRIPTION OF THE DRAWINGS

FIG. 1(C) is a side view showing a situation when adjacently arranged filament sections are contacted with each other.

FIG. 2 shows a construction of one example of an attachment of the present invention and FIG. 2(A) shows a front view of a rear side of the attachment, while FIG. 2(B) shows a schematic view thereof.

FIG. 5 (B) is a side view of the apparatus as shown in FIG. 5(A).

FIG. 22(A) shows a left-hand-side side view of the apparatus while FIG. 22(B) shows a right-hand-side side view thereof.

FIG. 24(A) is a cross-sectional view of an auxirially supporting member and FIG. 24(B) is a cross-sectional view of a connecting bar controlling means.

DETAILED DESCRIPTION OF THE PREFERRED EMBODIMENTS

The specific embodiments of the attachment as used in the apparatus for attaching a tag-attaching pin of the present invention will be explained hereunder with reference to the attached drawings.

Figure 1:
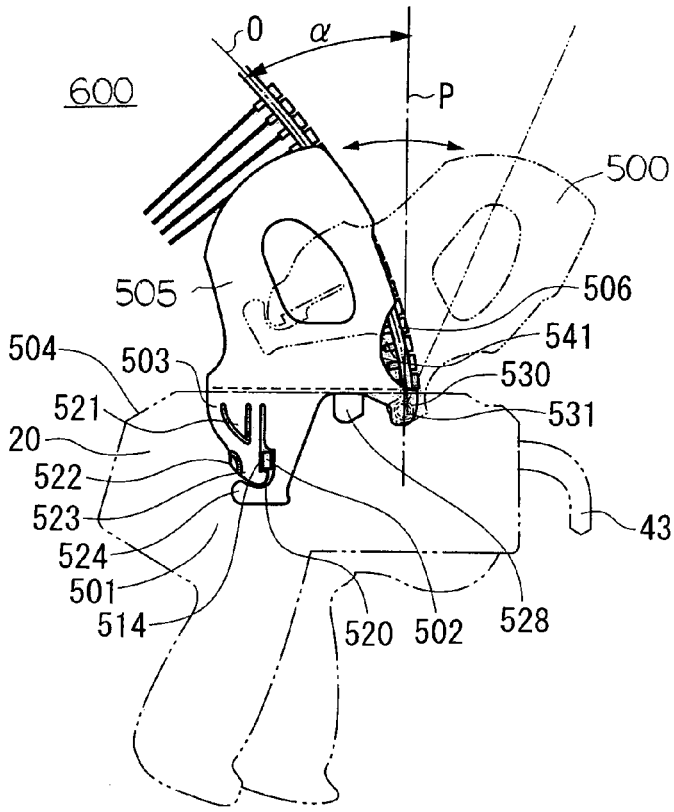
FIG. 1 (A) is a front of view of an attachment of the present invention and FIG. 1 (B) is a schematic view thereof.
Figure 1:
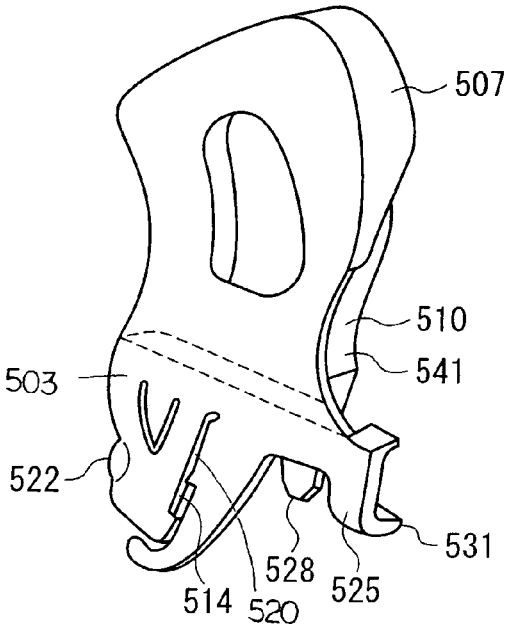
Figure 1:
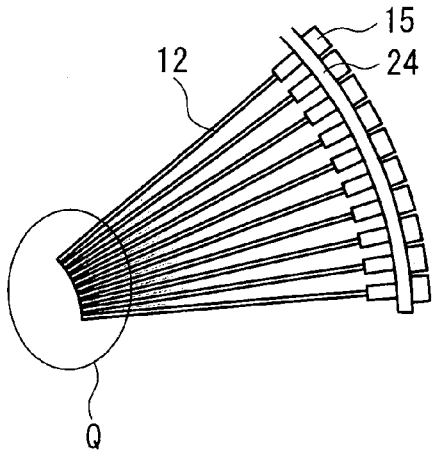

Note that, FIG. 1 shows a construction of one embodiment of the attachment which can be detachably connected to an apparatus for attaching a tag-attaching pin as used in the present invention.

Figure 7:
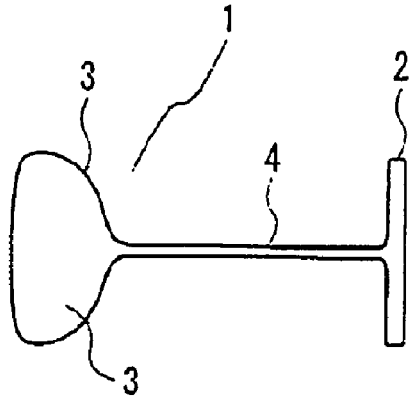
Fig. 7 PRIOR ART
FIG. 7 is a drawing showing the configuration of a specific example of a conventional tag-attaching pin used in the present invention.
Figure 9:
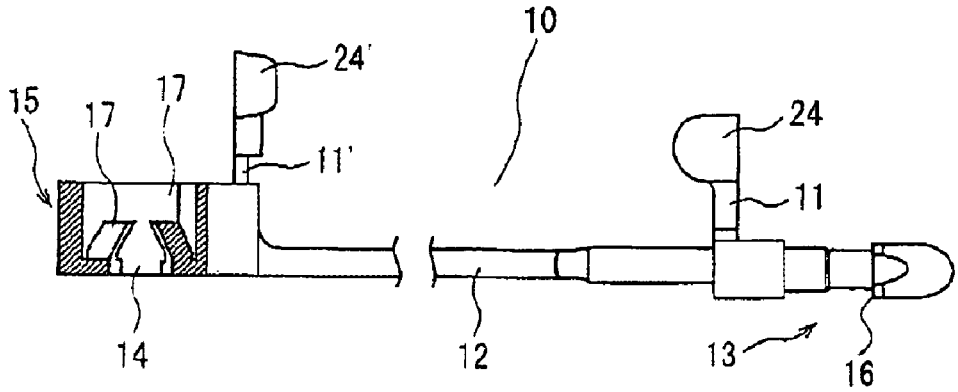
Fig. 9 PRIOR ART
FIG. 9 is a drawing showing another configuration of a separate embodiment of a conventional tag-attaching pin.
Figure 10:
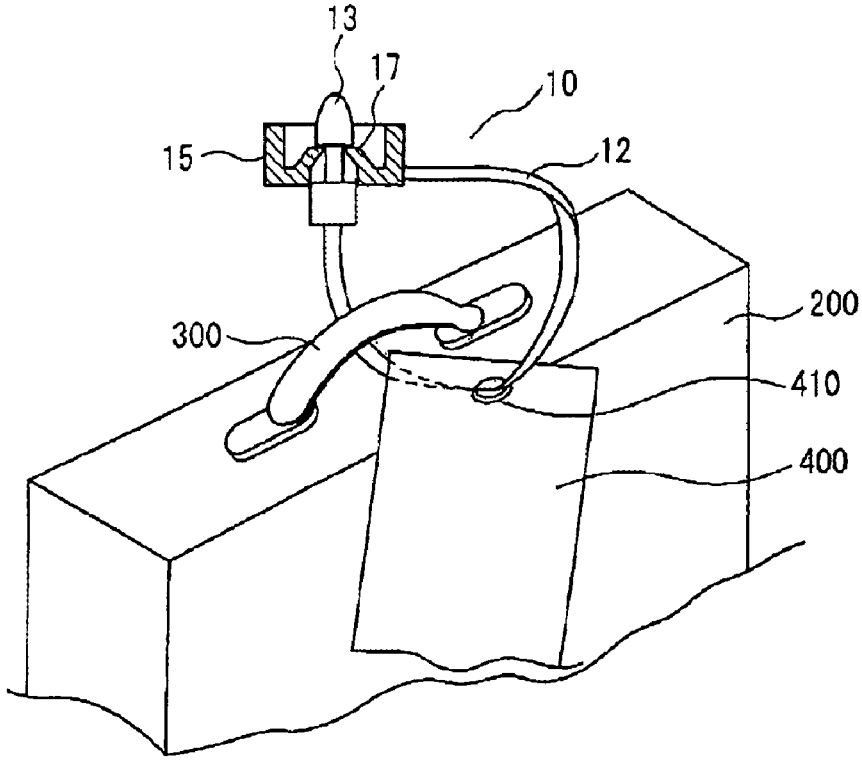
Fig. 10 PRIOR ART
FIG. 10 is a schematic view showing a configuration of a specific embodiment of the present invention utilizing the conventional tag attaching pin as shown in FIG. 9.

With reference to FIGS. 7 and 9, FIG. 1 shows an attachment 500 of the present invention, which can be used for an apparatus 20 using a sheet of tag-attaching pins 600 in which a plurality of tag-attaching pins 1 or 10, each comprising a filament section 4 or 12, an inserting head section 2 or 13 provided at one end of the filament section 4 or 12, and a socket section 15 or a holding section 3 provided at the another end of the filament section, are mutually arranged in parallel configuration. At least the inserting head section 2 or 13, or a portion in the vicinity of the inserting head section 2 or 13 or at least the socket section 15 or the holding section 3 or a portion in the vicinity of the socket section 15 or the holding section 3 of each one of the tag-attaching pins 1 or 10 thereof, are connected to connecting bars 24. This is so that the parallel configuration of the sheet of tag-attaching pins 600 can be maintained. The tag attaching pin 1 or 10 is attached to a desired good 100 with the holding section 3 by inserting the inserting head section 2 of the tag-attaching pin 1 or 10 into a hollow needle 21 provided on the tag attaching device 20 and by penetrating the inserting head section 2 or 13 through the good 200 by pushing the inserting head section 2 or 13 out of the hollow needle 21 utilizing a predetermined pin pushing means. This is so as to have the inserting head section 2 or 13 attached to a surface of the good 200 with the tag attaching pin 1, or to have the inserting section 2 or 13 engaged with the socket section 15 of the tag-attaching pin 12 with the tag 400 via a part of the good 300 so that a tag 5 is kept by the filament section 4 or 12. The attachment 500 is provided with a connecting portion 503 which can be detachably coupled with a coupling means 502 formed on a side wall surface of the apparatus for attaching a tag-attaching pin 20 and a tag attaching pin controlling means 505. The means 505 is provided on the side wall surface 501 of the apparatus for attaching a tag-attaching pin 20 and extends upwardly from a top surface 504 of the apparatus for attaching a tag-attaching pin 20. The coupling means 502 and the tag attaching pin controlling means 505 are integrally formed with each other. A connecting bar controlling means 507, which can control an arranged locus configuration 506 of the connecting bars 24 of the sheet of the tag-attaching pins 600, is formed on at least a portion of the tag attaching pin controlling means 505.

Note that the attachment 500 of the present invention is provided with a connecting portion 503 which can be detachably connected to the apparatus for attaching a tag-attaching pin 20 via a coupling means 502 provided on a surface of a side wall surface 501 of the apparatus 20 and a tag attaching pin controlling means 505. The means 505 is provided on the side wall surface 501 of the an apparatus 20, which is integrally formed with the connecting portion 503 and extends upwardly from an upper top surface 504 and the side surface 501 of the apparatus 20 so as to form a wall like configuration.

The tag attaching pin controlling means 505 which forms the attachment 500 of the present invention, is also provided with a connecting bar controlling means 507. The means 507 has a function to fix an arranged locus configuration 506 of the connecting bars 24 of the sheet of the tag-attaching pins 600 into a prescribed constant shape by engaging with the connecting bar 24 which is a part of a sheet of tag-attaching pins 600.

On the other hand, it is preferable that the connecting bar controlling means 507 may be provided at a relatively upper side portion of the tag attaching pin controlling means 505, for example.

Figure 2:
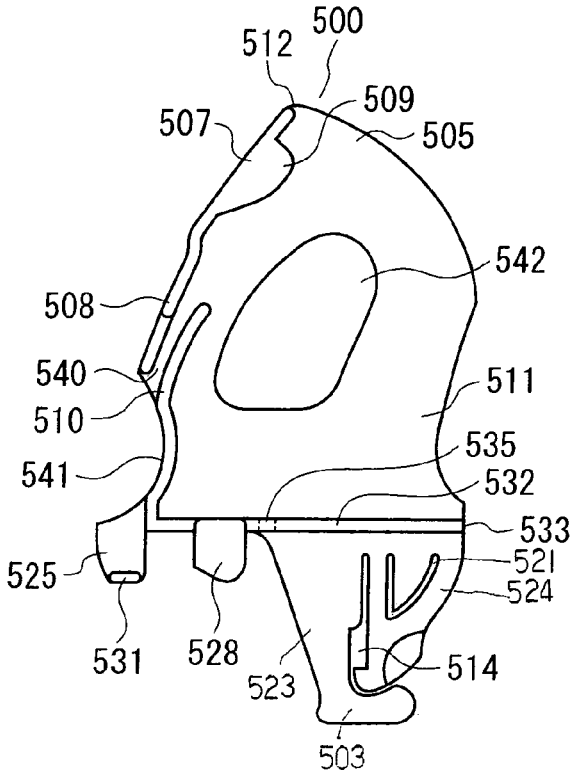
Figure 2:
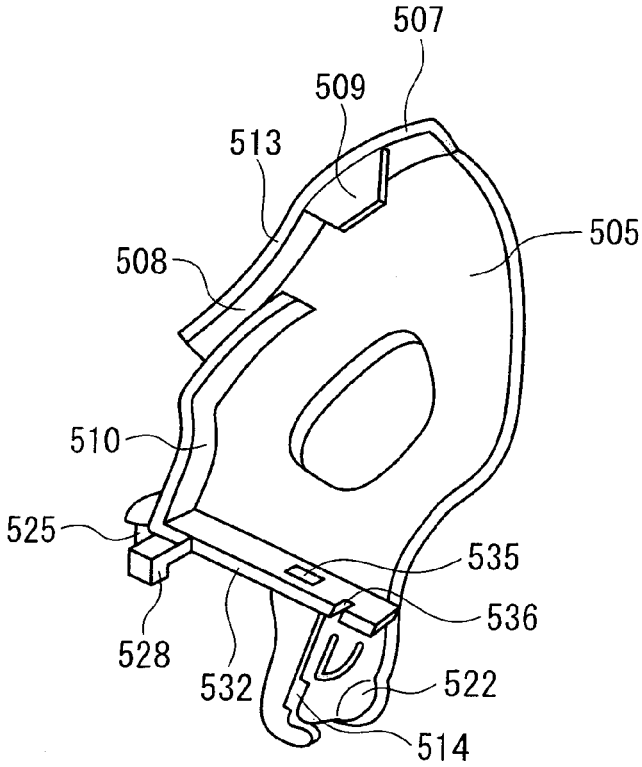

For example, as shown in FIG. 2, it is also preferable that the connecting bar controlling means 507 can comprise a guide wall portion (a first guide wall portion) 508 for forming an arranged locus configuration of the connecting bar 24 having a predetermined height and arranged along an outer edge portion 512 of a base plate 511 of the tag attaching pin controlling means 505; and a connecting bar locus configuration holding means 509 which is provided on a part of a free end edge portion 513 of the guide wall portion 508 and formed in parallel with a surface of the base plate 511.

The height of the guide wall portion 508 is not specifically restricted to a predetermined value though, it can be designed, for example, to have a desired height taking into account of a length of a connecting portion 11. The connecting portion 11 connects the inserting head section 2 or 13 to the connecting bar 24 in the sheet of tag-attaching pins 600 or a length of a connecting portion 11 which is connecting the holding section 3, or the socket section 15 to the connecting bar 24 in the sheet of tag-attaching pins 600.

Further, inside the guide wall portion 508, an auxiliary guide wall portion (a second guide wall portion) 510 which can keep the locus configuration of the connecting bars 24 at a prescribed shape, is provided.

Note that in a specific embodiment of the tag attaching pin controlling means 505, the tag attaching pin controlling means 507 of the tag attaching pin controlling means 505 can be formed at least a part of the outer peripheral edge portion 512 of the tag attaching pin controlling means 505 and facing a direction of a front end portion of the apparatus 20. More specifically, the tag attaching pin controlling means 507 comprises a first guide wall portion 508 for guiding the connecting bar 24 to form a predetermined locus configuration and a connecting bar locus configuration holding means 509.

Further, in the tag attaching pin controlling means 505 of the present invention, as shown in FIG. 2, it is a preferable embodiment of the present invention in that in an inside portion of the first guide wall portion 508, a second guiding wall portion 510 is provided on a surface of the tag attaching pin controlling means 507 which is the same surface on which the connecting bar controlling means 505 is provided and wherein the a second guiding wall portion 510 can be contacted with a surface of the connecting bar 24, the surface thereof being opposite to a surface thereof to which the first guiding wall portion 508 is contacted.

In the attachment 500 of the present invention, since it adopts the above-mentioned technical features, when the sheet of tag-attaching pins 600 is mounted on an apparatus for attaching a tag-attaching pin 20, a part of the connecting bar 24 forming the sheet of tag-attaching pins 600 is forced to be arranged along a guiding groove 540. The guiding groove 540 is formed with the first and the second guiding walls 508 and 510 and thus the arranged locus configuration thereof is fixedly kept at it is. Accordingly, the problems in that the sheet 600 is swung or is dropped out from the apparatus during an operation can be effectively prevented.

In the present invention, the arranged locus configuration 0 formed by the connecting bar 24 which is one of the elements of the sheet of tag-attaching pins 600 utilizing the attachment 500 of the present invention, is preferably configured so that an angle $\alpha$ formed between the arranged locus configuration formed by the connecting bar 24 of the sheet 600 created by the attachment 500 and a normal line P with respect to a top upper surface 504 of the attachment 500 is set between 5 and 45 degrees.

For doing this, as one example, a configuration of a portion of the peripheral edge portion of the tag attaching pin controlling means 505 and which is a portion close to a front end portion of the apparatus 20 is preferably formed to have a configuration which is curved and directed toward a rear portion of the tag attaching pin controlling means 505 so that the predetermined angle $\alpha$ can be obtained.

Figure 12:
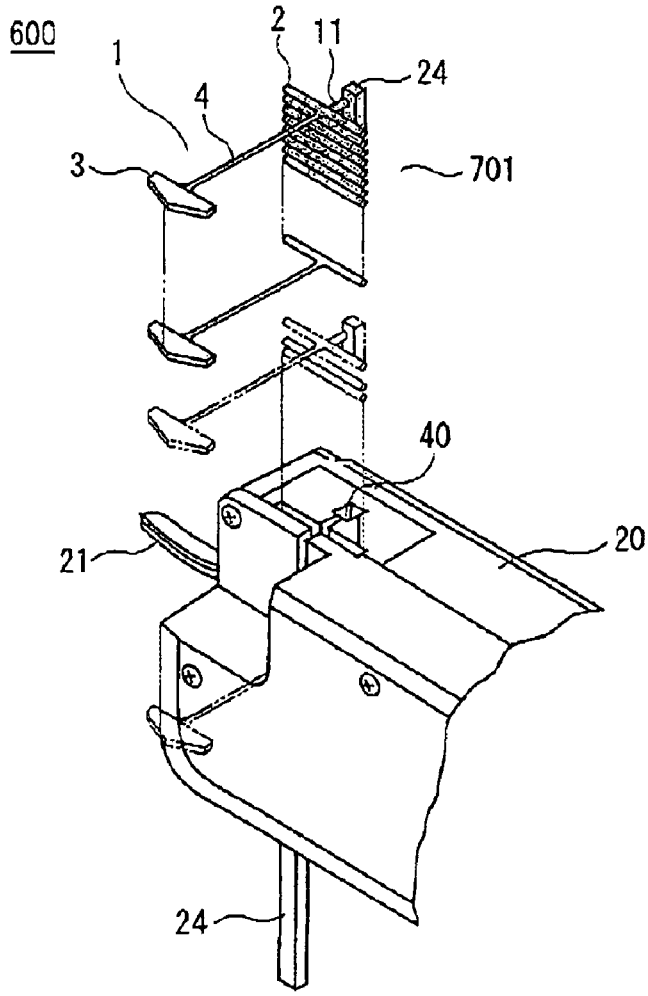
Fig. 12 PRIOR ART
FIG. 12 is a drawing illustrating one operational embodiment of a sheet of conventional tag-attaching pins which is mounted on the apparatus for attaching a tag-attaching pin shown in FIG. 11.

When the angle $\alpha$ is set at angle exceeding the upper limit thereof, for example, and when a sheet of tag-attaching pins 600 as shown in FIG. 12, is used, a plurality of adjacently arranged holding sections 3 provided on each one of the tag-attaching pin 1 are strongly contacted with each other. Therefore, an entanglement frequently occurs among the adjacently arranged holding sections 3 causing a tag-attaching pin shooting operation to fail.

Figure 13:
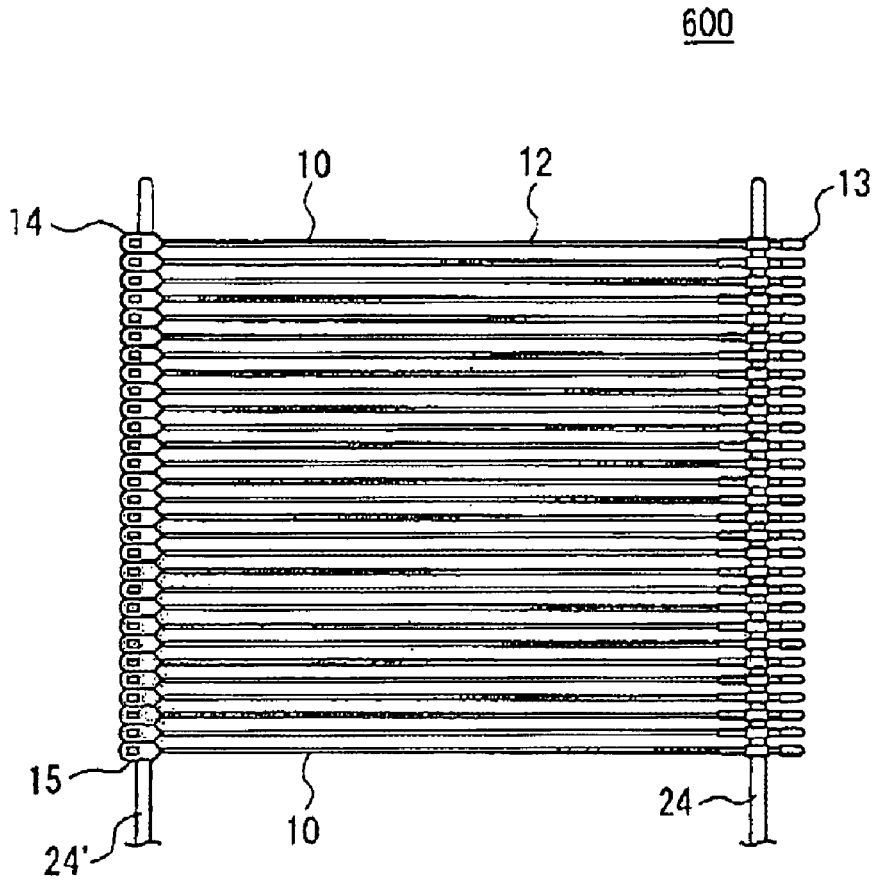
Fig. 13 PRIOR ART
FIG. 13 is a drawing illustrating another configuration of the conventional tag attaching pins.
Figure 14:
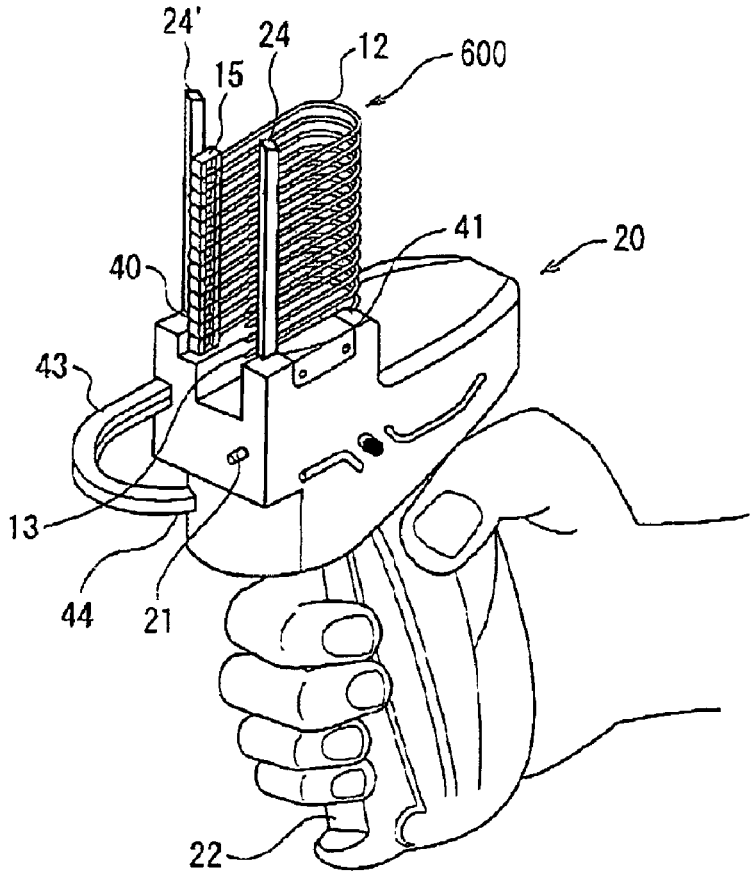
Fig. 14 PRIOR ART
FIG. 14 is a drawing showing another configuration of the apparatus for attaching a conventional tag attaching pin.
Figure 15:
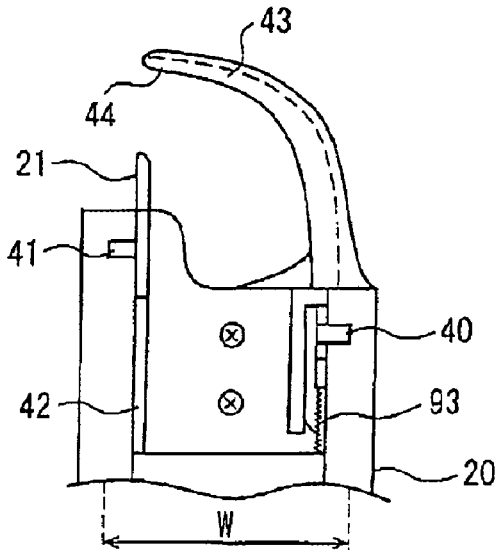
Fig. 15 PRIOR ART
FIG. 15 is a top plan view of the apparatus for attaching a conventional tag attaching pin as shown in FIG. 14.

On the other hand, when a sheet of tag-attaching pins 600 as shown in FIG. 13 is used, and it is mounted on the apparatus 20 as shown in FIG. 14, since it is mounted thereon by bending each one of the filament sections 12 of the tag-attaching pin 10 to form an U-like shape, when the angle $\alpha$ is set at angle exceeding the upper limit thereof, as shown in FIG. 1(*c*), a plurality of adjacently arranged filament sections 12 of each one of the tag-attaching pin 1 are strongly contacted with each other. Therefore, an entanglement frequently occurs among the adjacently arranged filament sections 12 causing a tag-attaching pin shooting operation to fail for the same reason as mentioned above.

The attachment 500 of the present invention comprises the tag attaching pin controlling means 505 and the connecting portion 503 each being integrally formed with each other and made of plastic material or metallic material or a composite material comprising the above-mentioned materials.

On at least one part of the connecting portion 503 of the attachment 500, a coupling means reception portion 514 which can be fixedly coupled with the coupling means (a first coupling means) 502 provided at the at least one of the side wall surfaces 501 of the apparatus for attaching a tag-attaching pin 20 and easily removed from the coupling condition formed therebetween.

It is preferable that the first coupling means 502 of the present invention is formed by a projecting portion or a recessed portion having a suitable height or a depth formed integrally with a surface of the first side wall surface 501 of the apparatus 20, and the plane configuration thereof is preferably either one of a rectangular shape, a circular shape, a polygonal shape, an oval shape or the like.

On the other hand, the coupling means reception portion 514 which can be detachably coupled with the first coupling means 502, which preferably has a plane configuration that is substantially identical to that of the first coupling means 502.

The coupling means reception portion 514 preferably has an opening having a plane shape comprising a combination of a plurality of inner peripheral edge portions 517, 518 each individually contacting to at least a part of the outer peripheral edge portions 515, 516 of the coupling means 502, respectively.

Further, at least a part of the inner peripheral edge portions 517, 518 of the coupling means reception portion 514 which can be coupled with the first of connecting portion 502 is preferably configured so that it can be easily displaced independently so as to change its position with respect to another inner peripheral edge portion and in order to easily attach to or be removed from the first coupling means 502.

Figure 3:
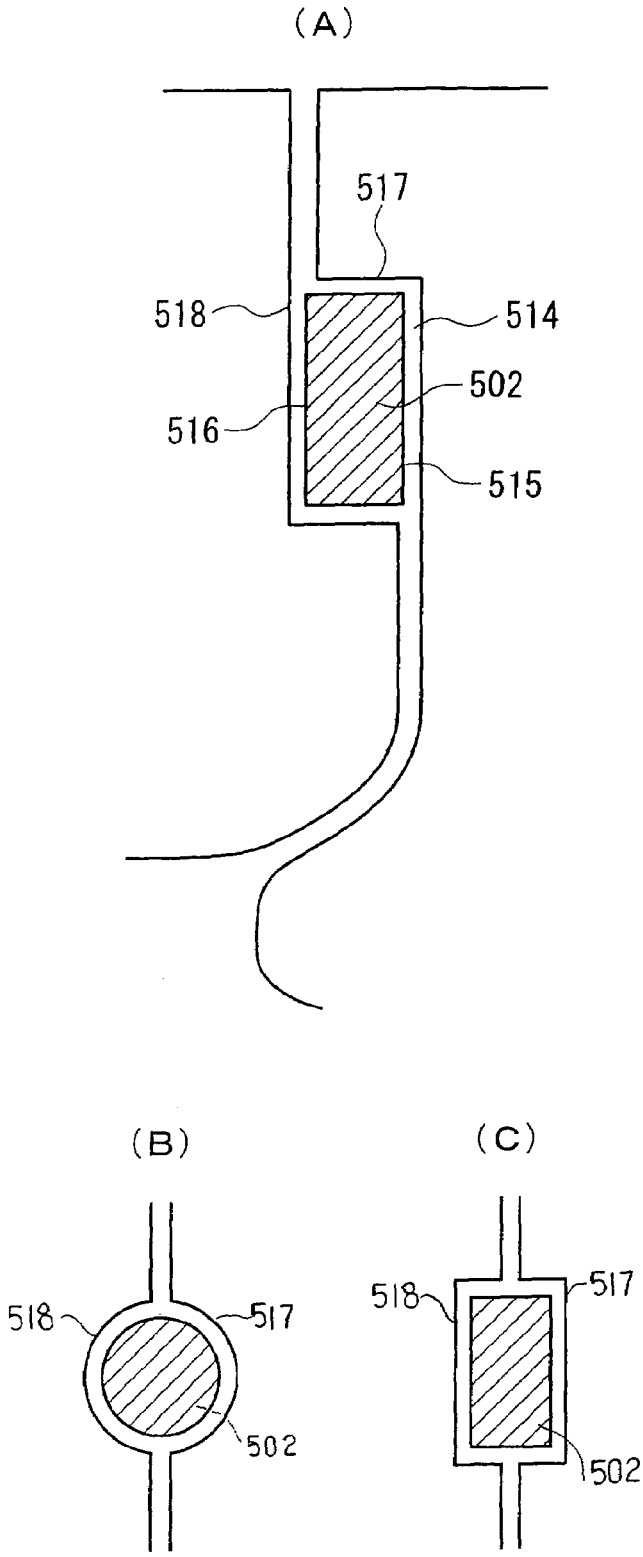
FIGS. 3 (A), 3(B) and 3(C) illustrate examples of specific constructions of a coupling means and a coupling means reception portion used in the present invention and also show a coupling configuration formed therebetween.

Note that, in the coupling means reception portion 514 as shown in FIG. 3, for example, the second inner peripheral edge portions 518 is configured so that it can easily move to displace from its original position with respect to the first inner peripheral edge portions 517.

Specifically, the second inner peripheral edge portions 518 is configured so that it can easily change its position upward with respect to the first inner peripheral edge portions 517 in an upper direction of a surface of the paper of FIG. 3.

For one embodiment of the present invention, the connecting portion 503 comprises a first connecting portion 523 and a second connecting portion 524 each being separated from each other by a first slit portion 520 interposed therebetween. The coupling means reception portion 514 is preferably provided on a part of the first slit portion 520.

Further, as mentioned above, in the present invention, since it is preferable that one of the first and the second connecting portions is configured to displace its position with respect to another connecting portion, in order to realize this configuration, the present invention introduces a mechanism in that the first connecting portion 523 is configured to be movable to easily displace its position.

More specifically, as shown in FIGS. 1 and 2, the first connecting portion 523 is provided with a second slit portion 521 having, for example, a U-shaped or a V-shaped configuration and with this construction, the first connecting portion 523 can be easily moved upward and be displaced with respect to the second connecting portion 524.

Further, in the present invention it is preferable that a space portion 522 is provided at a portion formed between a part of an external peripheral edge portion of the first connecting portion 523 in which the second slit portion 512 is provided and the side wall surface of the apparatus for attaching a tag-attaching pin 20, and the space portion 522 being formed by raising a part of the outer peripheral edge portion of the first connecting portion 523 upward.

Due to this construction of the present invention, by inserting a tip portion of a driver or a coin into this space portion 522, the first connecting portion 523 can be easily lifted up so that the engagement formed between the apparatus for attaching a tag-attaching pin 20 and the attachment 500 can be easily disengaged.

Apparently, in the present invention, the configuration of the coupling means reception portion 514 make it possible that the apparatus for attaching a tag-attaching pin 20 and the attachment 500 can to be easily engaged with each other.

On the other hand, the attachment 500 of the present invention is preferably provided with an additional auxiliary supporting mechanism, since it is difficult to fixedly support the attachment 500 to a surface of a side wall of the apparatus for attaching a tag-attaching pin 20 effectively with only the above-mentioned connecting portion 503.

Note that, as one example to do so, as shown in FIGS. 1 and 2, at a portion of the connecting portion 503 and which is in the vicinity of a front end portion of the apparatus for attaching a tag-attaching pin 20, more specifically, at a portion in the vicinity of a front end portion of the second connecting portion 524, it is preferable that there are provided a first supporting member 525 which can engage with a top upper surface 504 of the apparatus 20 and a first side wall surface 501 of the apparatus 20, and a second supporting member 528 which can engage with a top upper surface 504 of the apparatus 20 and a second side wall surface 529 provided on an opposite side of the first side wall surface 501 thereof or an inside side wall surface 526 of the second side wall surface 501.

Further, in the present invention, on the first side wall surface 501 of the first connecting portion 525 of the apparatus 20, it is preferable that a projecting portion (a second coupling means reception portion) 531 which can be engaged with a recessed portion (a second coupling means) 530 which is provided on the first side wall surface 501 of the apparatus 20, is provided.

In addition to thereabove, the connecting portion 503 and the tag attaching pin controlling means 505 are integrally formed into one piece. Furthermore, an auxiliary supporting member 532 is preferably provided along a border line 533 formed between the connecting portion 503 and the tag attaching pin controlling means 505, or a line formed in the vicinity of this border line 505.

Figure 5:
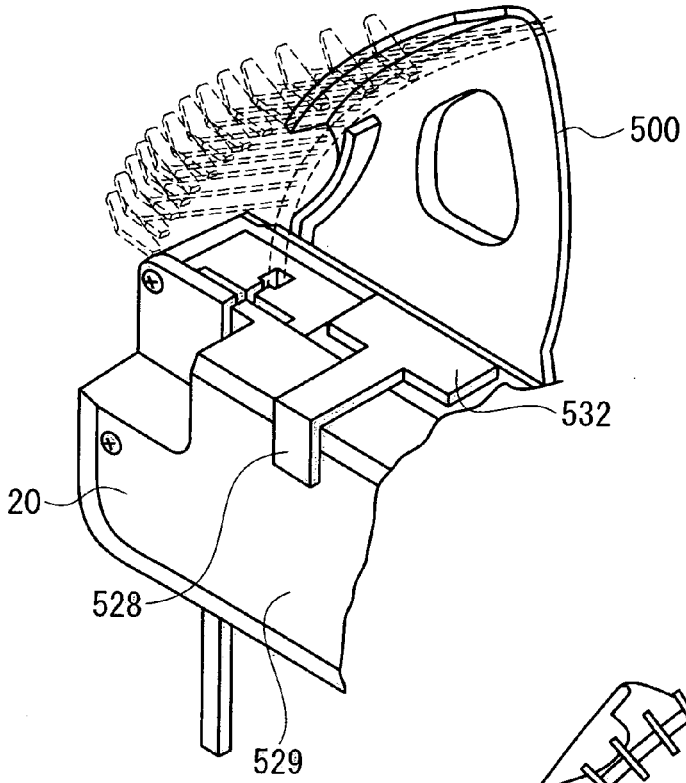
FIG. 5 (A) is a rear side schematic view of another embodiment of a apparatus for attaching a tag-attaching pin of the present invention in which an attachment of the present invention having a different configuration from that as used in FIG. 4, is mounted on the apparatus having a different configuration from that of the apparatus as shown in FIG. 4.
Figure 5:
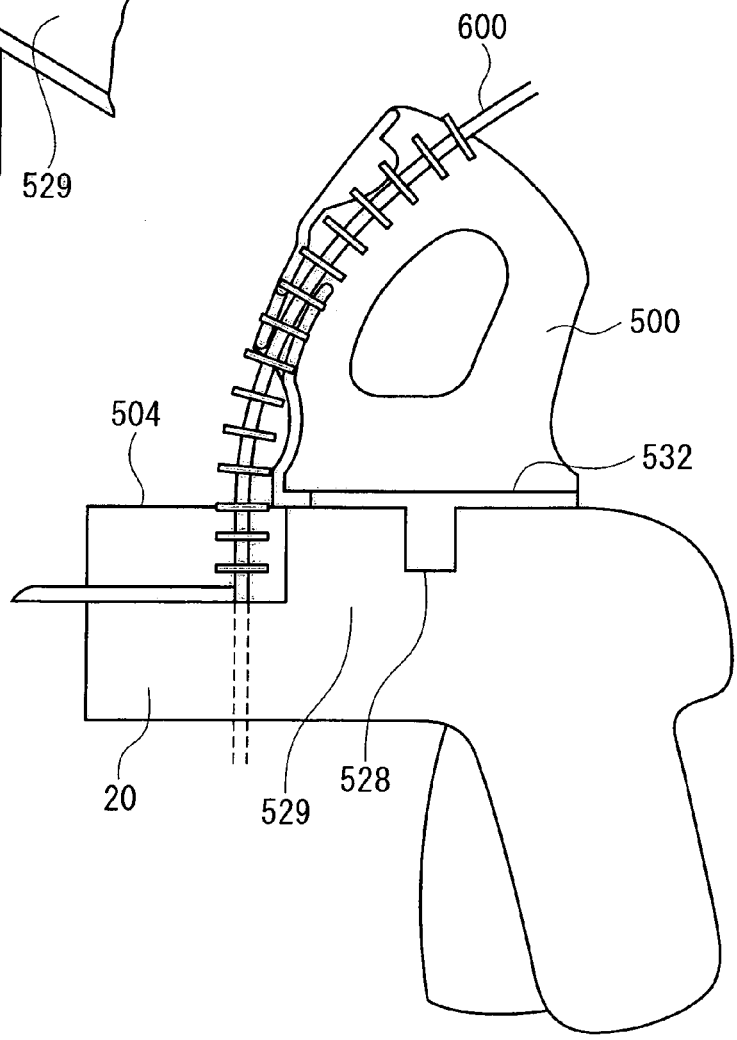
Figure 6:
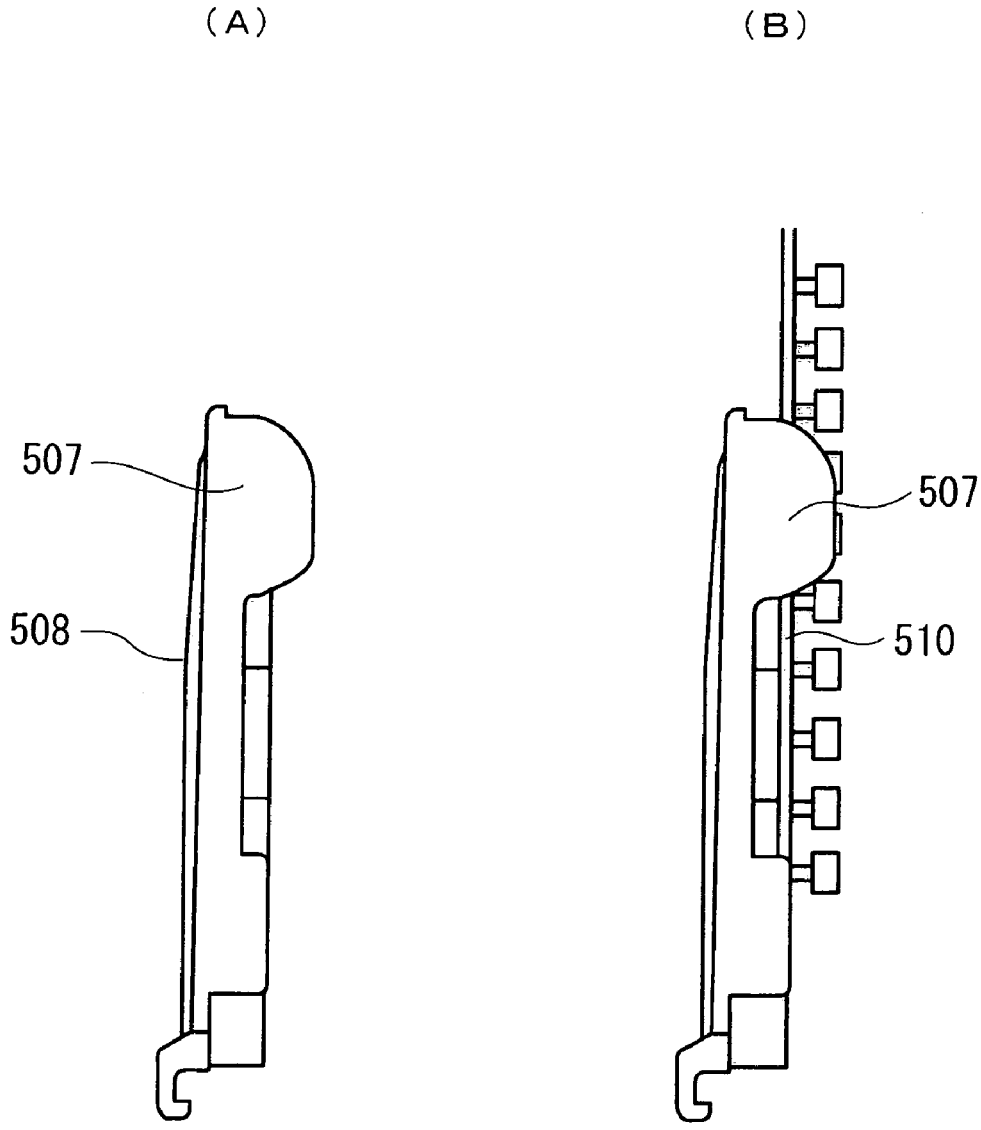
FIG. 6 is a drawing showing the configuration of right hand side edge portion of one embodiment of the attachment used in the present invention.

Note that, in the present invention, when the a sheet of tag-attaching pins 600 as shown in FIG. 12 and the apparatus for attaching a tag-attaching pin 20 are used, one specific embodiment of the present invention showing how to attach the attachment 500 to the apparatus 20 is illustrated in FIG. 5.

In FIG. 5, a length of the second supporting member 528 is relatively longer since the second supporting member 528 is elongated so as to reach to a side wall surface (a second side wall surface) 529 which is an opposite side wall surface 501 of the apparatus 20.

Figure 4:
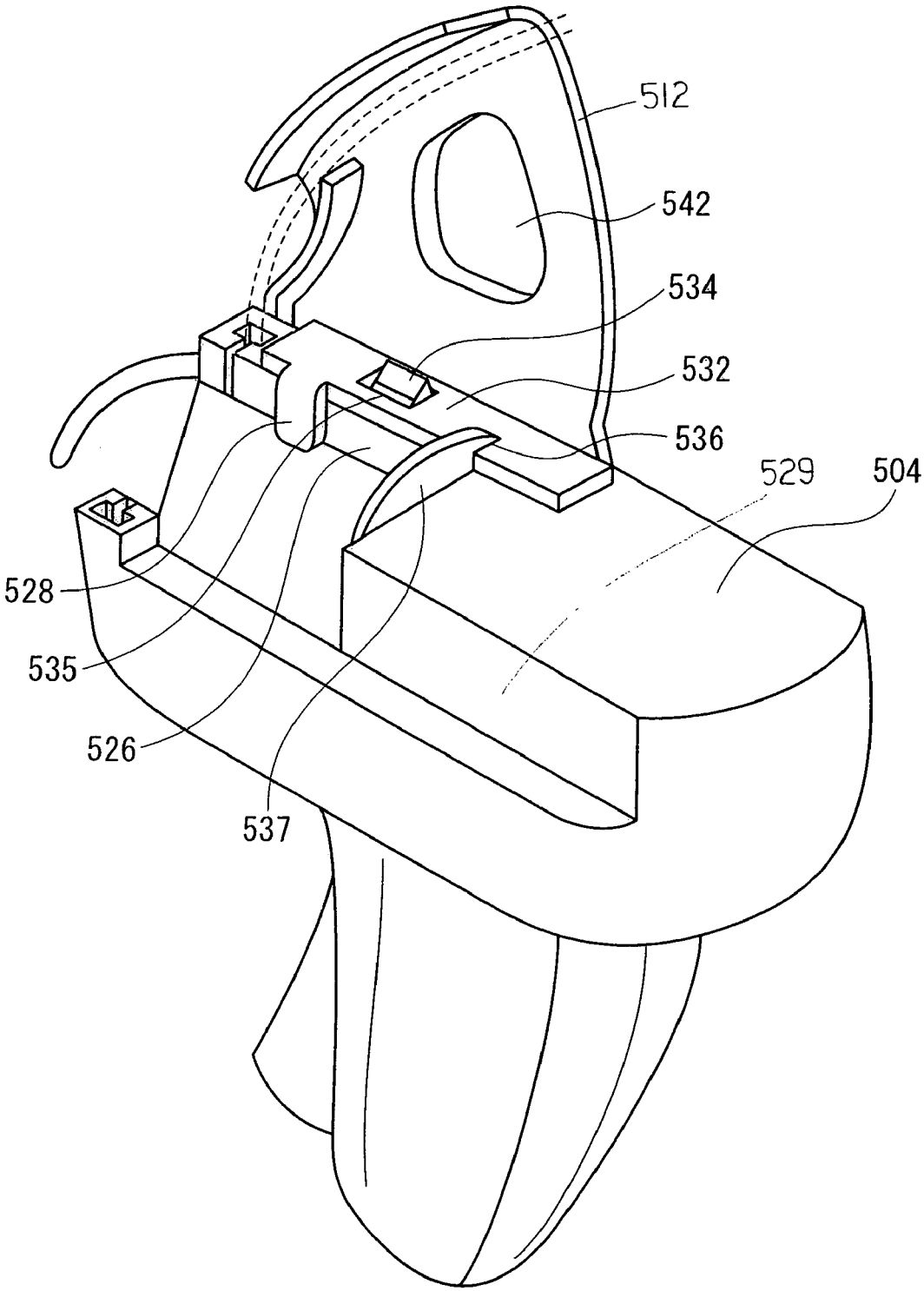
FIG. 4 is a rear side schematic view of one embodiment of a apparatus for attaching a tag-attaching pin of the present invention in which an attachment of the present invention is mounted on the apparatus.
Figure 16:
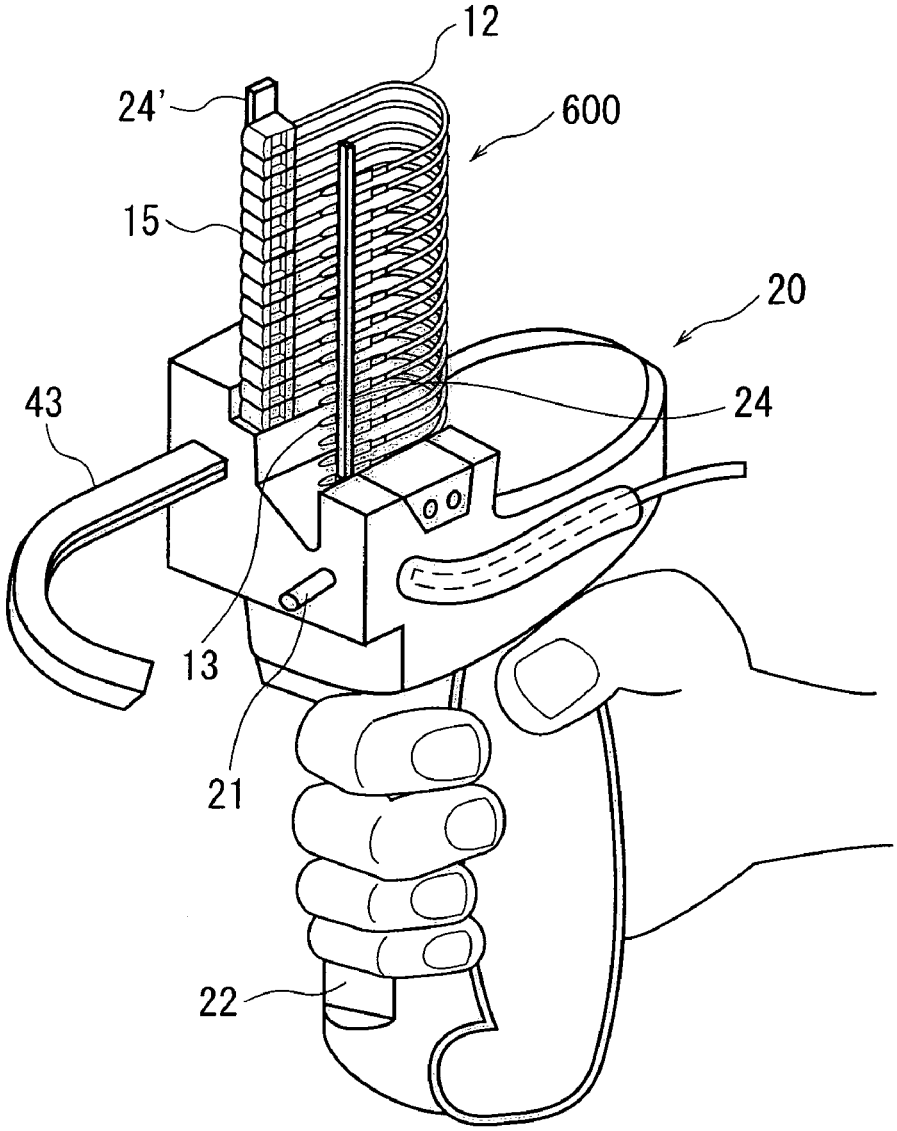
FIG. 16 is a drawing illustrating a configuration of an another specific embodiment of an apparatus for attaching a tag-attaching pin of the present invention.

On the other hand, in the present invention, in a case when the sheet of tag-attaching pins 600 as shown in FIG. 16 and the apparatus for attaching a tag-attaching pin 20 are used, one specific embodiment of the present invention showing how to attach the attachment 500 to the apparatus 20 is illustrated in FIG. 4.

In FIG. 4, the second supporting member 528 is configured so that it can be engaged with a step like portion formed by an inside side wall surface 526 of the second side wall surface 529 which is an opposite side wall surface to the surface of the apparatus 20 on which the attachment 500 of the present invention is attached.

Further, in the present invention, when the sheet of tag-attaching pins 600 shown in FIG. 14 and the apparatus 20 are used, a specific embodiment for how to attach the attachment 500 of the present invention to the apparatus for attaching a tag-attaching pin 20 is not shown though, an attaching mechanism which is substantially identical to that shown in FIG. 4 can be provided on a first side wall surface formed in the vicinity of a portion on which a slit 40 for inserting the connecting bar thereinto is provided, or on a second side wall surface formed opposite to the first side wall surface and formed in the vicinity of a portion on which a slit 41 for inserting the connecting bar thereinto is provided.

It is one of preferable embodiments of the present invention in that the auxiliary supporting member 532 is configured so that it can be detachably contacted tightly to a top upper surface 504 of the apparatus 20.

Further, it is also preferable in that the second supporting member 528 is connected to a part of a free end portion of the auxiliary supporting member 532.

In addition, in order to strengthen the connecting condition between the attachment 500 and the apparatus for attaching a tag-attaching pin 20 in the present invention, it is also preferable that a projecting portion or a recessed portion 534 having a prescribed configuration is provided on a portion of a top end surface 504 of the apparatus 20 and an opening or a projecting portion 535 which can be coupled with the projecting portion or the recessed portion 534 previously provided on the top end surface 504 of the apparatus 20, is provided on the auxiliary supporting member 532.

On the other hand, in the present invention, on a part of the auxiliary supporting member 532, there is provided a third slit portion 536 which can be engaged with a suitable plate-like projecting portion 537 which is provided on a part of the apparatus 20.

On the other hand, it is also preferable embodiment of the present invention in that a recessed portion 541 is provided on a portion of a part of the external peripheral edge portion 512 of the tag attaching pin controlling means 505 and the portion being formed in a direction to a front end portion of the apparatus 20 as well as on the portion formed at a position in the vicinity of the top upper end surface 504 of the apparatus 20.

The recessed portion 541 makes an inserting operation done by an operator easy. The inserting operation is such that when the operator of the apparatus 20 mounts the sheet of tag-attaching pins 600 on the apparatus for attaching a tag-attaching pin 20, he or she should pick up the connecting bar 24 of the sheet 600 with his or her finger and try to insert an end portion of the connecting bar 24 into the slit 40 or 41.

On the other hand, on a part of the tag attaching pin controlling means 505 of the present invention, it is preferable that an aperture 542 is provided.

Note that it is apparent that in order to increase a stability and strength of the tag attaching pin controlling means 505, it should have some area and thickness with some extent, however, this aperture 542 is an effective means to reduce a weight of the tag attaching pin controlling means 505.

Next, separate embodiments of the present invention will be explained hereunder with reference to the FIGS. 17 to 27.

Note that, one of the separate embodiments of the present invention is an attachment 500 which has a construction different from that of the attachment 500 shown in FIGS. 1 to 5. In the previous attachment shown by FIGS. 1 to 5, the connecting portion 503 comprises the first and the second connecting portions and both connecting portions are so configured that each thereof being able to be individually displaced from each other.

However, in the present embodiment, an attachment 500 having a connecting portion 503 formed integrally into one piece and which is easily and detachably connected to the apparatus for attaching a tag-attaching pin 20, is provided.

Figure 17:
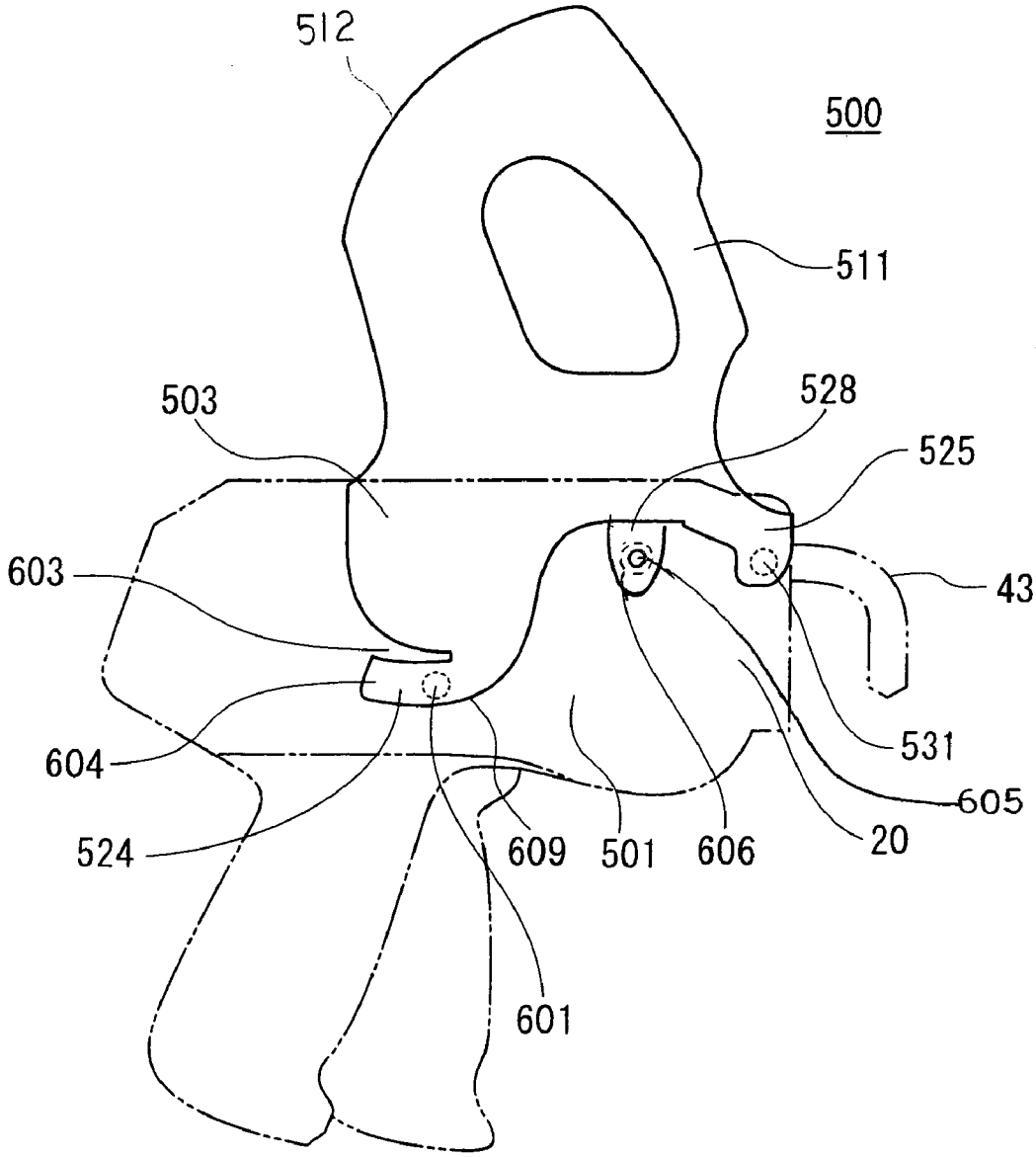
FIG. 17 is a side view of a separate embodiment of an attachment used in the present invention.
Figure 18:
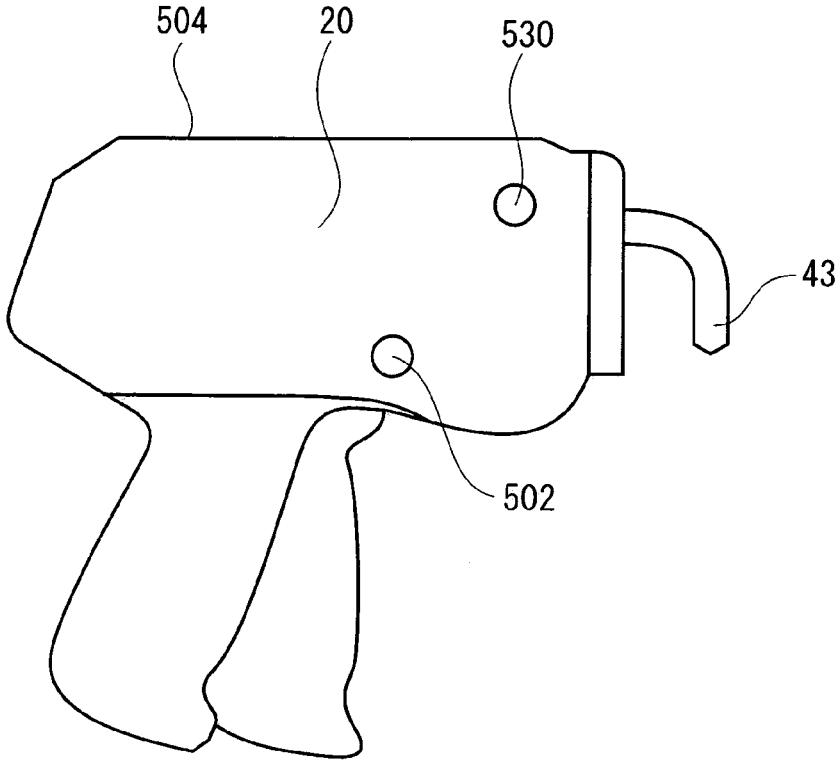
FIG. 18 is a side view showing one embodiment of a configuration of an apparatus for attaching a tag-attaching pin to which an attachment as shown in FIG. 17 is mounted.
Figure 19:
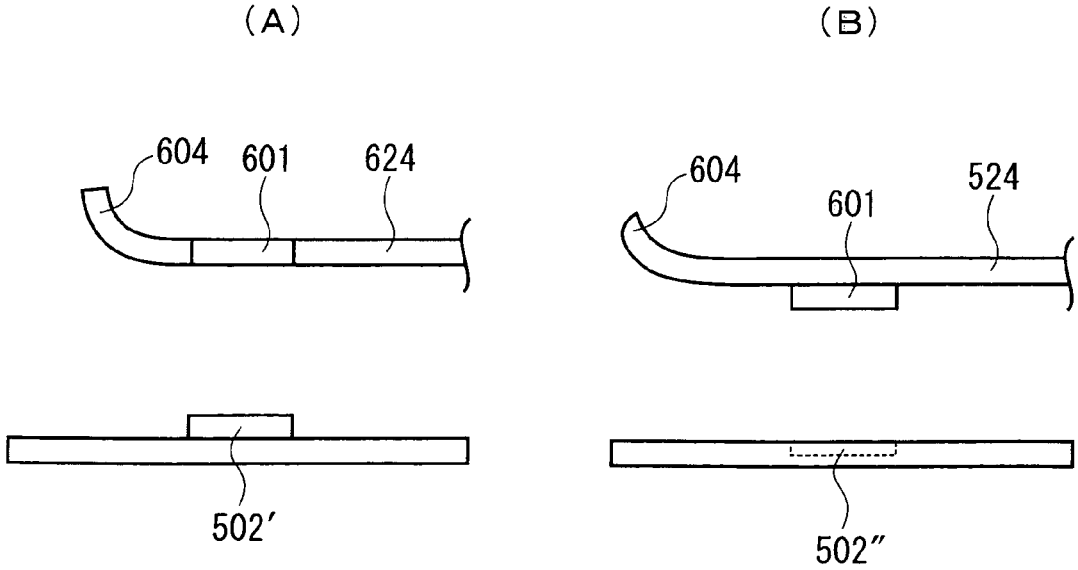
FIG. 19 show cross-sectional views of configurations of another embodiment of a connecting portion provided on the attachment as shown in FIG. 17.

Note that, as shown in FIG. 17, although a construction of this embodiment basically shows a similar construction to that of the previous embodiment as shown in FIGS. 1 to 5, a contacting mechanism of the attachment 500 to the apparatus 20 has been changed.

Note that, in this embodiment as shown in FIG. 17, the attachment 500 has the technical feature such that on a portion of the connecting portion 503 located in the vicinity of a front end portion of the apparatus for attaching a tag-attaching pin 20, there is provided a first supporting member 525 which can engage with a top upper surface 504 of the apparatus 20 and a side wall surface (a first side wall surface) 501 of the apparatus 20, and a second supporting member 528 which can engage with a top upper surface 504 of the apparatus 20 and a second side wall surface 529 provided on an opposite side of the first side wall surface 501 thereof or an inside side wall surface 526 of the second side wall surface 529. On a portion of a surface of the connecting portion 503 and which is facing to and contacted to the first side wall surface 501 of the apparatus 20, there is provided a first coupling means reception portion 601 which can be engaged with the first coupling means 502 provided on the first side wall surface 501 of the apparatus 20. On a portion of a surface of the first supporting member 525 and which is facing to and contacted to the first side wall surface 501 of the apparatus 20, there is provided with a second coupling means reception portion 531 which can be engaged with the second coupling means 530 provided on a portion formed in the vicinity of a front end portion of the apparatus 20.

In this embodiment, the connecting portion 503 is integrally formed into one piece. Since the connecting portion 503 is attached to the apparatus for attaching a tag-attaching pin 20, the first coupling means 502 provided on the first side wall surface 501 of the apparatus 20 is arranged at a slightly lower position of a main body of the apparatus 20 compared with the previous embodiment. A position of the first coupling means reception portion 601, which can be engaged with the first coupling means 502 in the connecting portion 503, is arranged at a position near the vicinity of a lower portion of the connecting portion 503.

Further in this embodiment, it is preferable to have a picking up portion 604 to provide a space portion that is formed between the first side wall surface 501 of the apparatus and a portion of an external peripheral edge portion 609 of the connecting portion 503, and which is located in the vicinity of the first coupling means reception portion 601.

By doing this, an operator can easily remove the connecting portion 503 from the side wall surface 501 by hooking his or her finger on this picking up portion 604.

And further, in this embodiment, in order to perform the function of the picking up portion 604 easily, a suitable slit portion 603 can be preferably provided.

On the other hand, in this embodiment, it is further preferred that a third coupling means reception portion 606 is provided which can be engaged with a third coupling means 605 provided on the second side wall surface of the apparatus 20 on a portion of a surface of the second supporting member 528, and which is facing to and contacted to the second side wall surface 526 or 529 of the apparatus 20.

In this embodiment, the third coupling means reception portion 606 which is provided on the second supporting member 528, is optionally provided. The second supporting member 528 can be configured so as to have a bias force which can press at the second side wall surface 526 or 529.

Note that, in order to realize this, the second supporting member 528 can be formed to have a configuration in which a tip end portion of the second supporting member 528 is slightly inclined to a direction facing to the second side wall surface 526 or 529, when it is molded.

In this embodiment, at least one of the first to the third supporting members 502, 530 or 605 preferably comprises a portion selected from a group of portions comprising a projecting portion, a recessed portion and a hole portion provided on either one of the side wall surfaces 501, 526 or 529 of the apparatus 20.

On the other hand, at least one of the first to the third coupling means reception portions 601, 531 or 606 comprises a portion selected from a group of portions comprising a projecting portion, a recessed portion and a hole portion each having a desired shape which can be coupled with either one of the projecting portion, the recessed portion and the hole portion forming the first to the third coupling means, respectively.

In order to attach the attachment 500 of the present invention to the apparatus for attaching a tag-attaching pin 20, for example, first, after the projecting portion 531 forming the second coupling means reception portion and inside portion of the first supporting member 525 of the attachment 500, is inserted into a hole portion 530 forming the second coupling means and provided on a front end portion of the apparatus 20. This is so as to couple them with each other, by rotating the main body of the attachment 500 in a counter clock wise direction as shown in FIG. 1. The connecting portion 503 is abutted to the first side wall surface 501 of the apparatus 20 and slid downwardly, at the same time the second supporting member 528 is also abutted to the second side wall surface 529 or 526 and slid downwardly.

And in the final step, when the first coupling means reception portion 601 provided at a front edge portion of the connecting portion 503 is coupled with the first coupling means 502 provided on the first side wall surface 501 of the apparatus 20, the attachment 500 can be surely connected to the apparatus 20.

On the other hand, when the attachment 500 is removed from the apparatus for attaching a tag-attaching pin 20, at first, an operator inserts his or her finger or the like into the space portion formed between the connecting portion 503 and a surface formed by the first side wall surface 501 of the apparatus 20. This is so as to lift the picking up means 604 provided at a lower portion of the connecting portion 503 and thereby the first coupling means reception portion 601 is removed from the first coupling means 502.

After the engagement formed between the first coupling means reception portion 601 and the first coupling means 502 has been released, by rotating the connecting portion 503 in a clockwise direction, the connecting portion 503 is removed from the side wall surface of the apparatus 20. Accordingly, the attachment 500 can be detached from the apparatus 20.

Next, a further different embodiment of the present invention will be explained hereunder.

Figure 8:
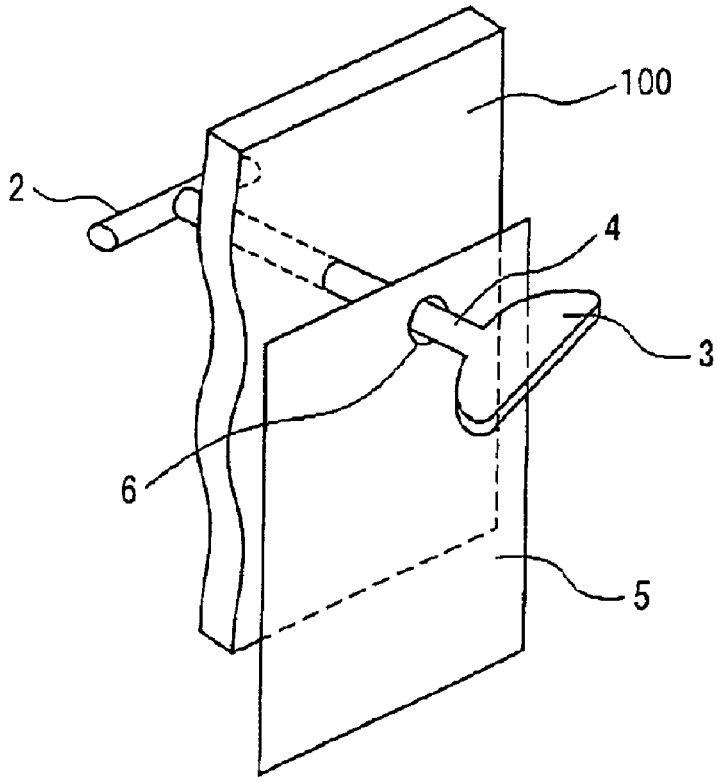
Fig. 8 PRIOR ART
FIG. 8 is a drawing illustrating the condition of use of the conventional tag-attaching pin of FIG. 7.
Figure 11:
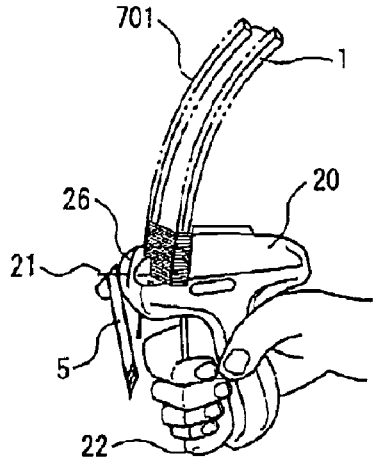
Fig. 11 PRIOR ART
FIG. 11 is a drawing illustrating a usage of a sheet of conventional tag-attaching pins in an apparatus for attaching a tag-attaching pin.

Note that an attachment 700 of this embodiment relates to a different attachment which can be used for an apparatus for attaching a tag-attaching pin 20 utilized with a sheet of tag-attaching pins 600 as shown in FIG. 5, 11 or 12, and especially as shown in FIGS. 7 and 8.

Figure 20:
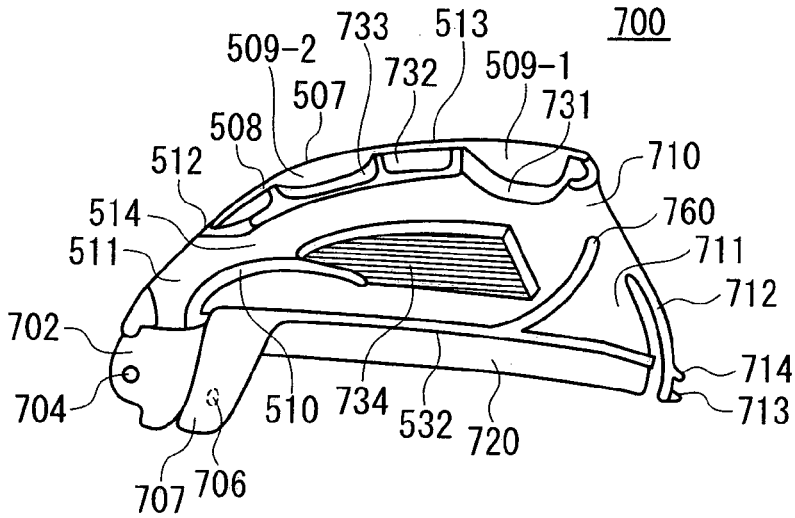
FIG. 20 is a right-hand-side side view of an embodiment of the attachment used in the present invention.
Figure 21:
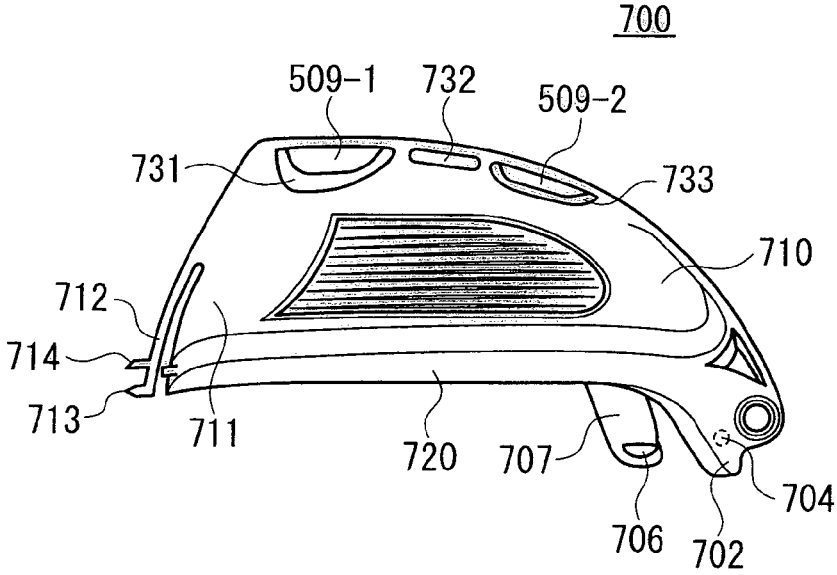
FIG. 21 is a left-hand-side side view of the attachment as shown in FIG. 20.

Note that an attachment 700 of this embodiment, as shown in FIG. 20, can be used for an apparatus using a sheet of tag-attaching pins 20 in which a plurality of tag-attaching pins 1, each comprising a filament section 4, an inserting head section 2 provided at one end of the filament section 4, and a holding section 3 provided at the another end of the filament section 4 are mutually arranged in parallel configuration and at least the inserting head section 2 or a portion in the vicinity of the inserting head section 2 is connected to a connecting bar 24. This is so that the parallel configuration of the sheet of tag-attaching pins 701 can be maintained. The tag 5 is attached to a desired good 100 with the holding section 3 by inserting the inserting head section 2 of the tag-attaching pin 1 into a hollow needle 21 provided on the apparatus for attaching a tag-attaching pin 20, and by penetrating the inserting head section 2 through the good 100 by pushing the inserting head section 2 out of the hollow needle 21 by utilizing a predetermined pin pushing means. This is so as to have the inserting section 2 attached to a surface of the good 100 with the tag 5. The attachment 700 is provided with a tag attaching pin controlling means 710 which can be attached to and mounted on a top upper surface 504 of the apparatus for attaching a tag-attaching pin 20, a first supporting member 702 which is integrally formed with the tag attaching pin controlling means 710 into one piece and which is provided with a first coupling means reception portion 704 being able to detachably couple with a first coupling means 703 formed on one side wall surfaces 501 of the apparatus 20, and a second supporting member 707 provided with a second coupling means reception portion 706 being able to detachably couple with a second coupling means 705 formed on another side wall surface 529 of the apparatus 20. The tag attaching pin controlling means 710 and the first and the second supporting members 702 and 707 are integrally formed into one piece. A connecting bar controlling means 507, which can control an arranged locus configuration of the connecting bars 24 of the sheet of the tag-attaching pins 701, is formed on at least a portion of the tag attaching pin controlling means 710.

Further in this embodiment, an attaching/detaching operation supporting member 712 for supporting an operation to attach or detach the tag attaching pin controlling means 710 to or from the apparatus 20, is preferably provided at a rear portion 711 of the tag attaching pin controlling means 710.

It is also preferable that the attaching/detaching operation supporting member 712 is provided with a movable member 715 to cause a spring effect at a part thereof and a third coupling means 713 formed at a free end portion of the attaching/detaching operation supporting member 712 and which can be coupled with a suitable coupling means reception portion 716 formed on a top upper surface 504 of the apparatus 20.

In this embodiment, the attaching/detaching operation supporting member 712 is preferably provided at a rear end portion 711 of the tag attaching pin controlling means 710 by being integrally formed into one piece with the tag attaching pin controlling means 710 via a slit portion 717. It is also preferable that a tip end portion of the slit portion 717 is configured so that it is applied with a bias force in a direction of the tip end portion of the slit portion 717 being removed from a surface of the rear end portion 711 of the tag attaching pin controlling means 710.

With this configuration thereof, the third coupling means 713 provided at the tip end portion of the attaching/detaching operation supporting member 712 can be inserted into the third coupling means reception portion 716 comprising a suitable recessed portion which is provided on a suitable position of the top upper surface 504 of the apparatus 20. Thus, the attachment 700 can be fixedly connected to the top upper surface 504 of the apparatus 20.

Next, a construction of the tag attaching pin controlling means 710 of this embodiment will be precisely explained hereunder.

Note that the attachment 700 of this embodiment is provided with a first supporting member 702 and a second supporting member 707 which is detachably connected to the apparatus 20 via a first coupling means 703 and a second coupling means 705 each having a suitable shape and provided on the side wall surfaces 501 of the apparatus 20. The attachment 700 is also provided with a tag attaching pin controlling means 710 which is integrally formed with a connecting portion into one piece and the connecting portion being projected and extended upwardly from the side wall surface 501 of the apparatus 20 and extending beyond the top upper surface 504 of the apparatus so as to form a wall like configuration.

In this embodiment, the tag attaching pin controlling means 710 forming the attachment 700 is also provided with a connecting bar controlling means 507 having a function of fixing an arranged locus configuration 704 of the connecting bar 24 into a predetermined configuration, with the contacting of the connecting bar 24 forming a part of the sheet of tag-attaching pins 701.

The connecting bar controlling means 507 is preferably arranged, for example, at an upper portion of the tag attaching pin controlling means 710 and as shown in FIG. 20. For example, it is also preferable that the connecting bar controlling means 507 can comprise a guide wall portion (a first guide wall portion) 508 for forming a arranged locus configuration of the connecting bar 24 having a predetermined height and arranged along an outer edge portion 512 of a base plate 511 of the tag attaching pin controlling means 710, and a connecting bar locus configuration holding means 509-1 and 509-2 which is provided on a part of a free end edge portion 513 of the guide wall portion 508 and is formed in parallel with a surface of the base plate 511.

The height of the guide wall portion 508 is not specifically restricted to a predetermined value though, it can be designed, for example, to have a desired height taking into account a length of a connecting portion 11. The connecting portion 11 connects the inserting head section 2 or 13 to the connecting bar 24 in the sheet of tag-attaching pins 701.

Further, inside the guide wall portion 508, an auxiliary guide wall portion (a second guide wall portion) 510 which can keep the locus configuration of the connecting bars 24 at a prescribe shape, is provided.

Note that in this specific embodiment, a moving locus configuration controlling means 730 for controlling a movement of the insertion section 2 of the tag-attaching pin 1 is provided between the guide wall portion 508 and the connecting bar locus configuration holding means 509-1 and 509-2.

By using the moving locus configuration controlling means 730, a moving locus configuration of the sheet of tag-attaching pins 701 can be precisely controlled and it makes a smooth movement possible for controlling a movement of the sheet of tag-attaching pins 701.

Further in this embodiment, it is preferable that at a desired position of the base plate 511 of the tag attaching pin controlling means 710, the apertures 731, 732 or 733 for forming a thickness reduction portion or weight reduction portion can be provided.

Note that a portion assigned with a reference number of 734 as shown in FIG. 20 shows a suitable design portion.

Apparently, in the tag attaching pin controlling means 710 of the present invention, since it adopts the above-mentioned constructions, when the sheet of tag-attaching pins 701 is mounted on the apparatus for attaching a tag-attaching pin 20, a part of the connecting bar 24 consisting the sheet of tag-attaching pins 701 is forced to be arranged along the guiding groove 540 formed between the first and the second guiding walls 508 and 510. Thus, the arranged locus configuration thereof is stably fixed. Accordingly, the problems in that the sheet 701 is swung or is dropped out from the apparatus during an operation can be effectively prevented.

In the present invention, the arranged locus configuration 740 formed by the connecting bar 24 of the sheet of tag-attaching pins 701 created by the attachment 700, is preferably configured so that an angle $\alpha$ formed between the arranged locus configuration formed by the connecting bar 24 of the a sheet 701 and a normal line P with respect to a top upper surface 504 of the apparatus 20 is set at between 5 and 45 degrees.

For doing this, as one example, a configuration of a portion of the peripheral edge portion of the tag attaching pin controlling means 710 and which is a portion close to a front end portion of the apparatus 20 is preferably formed to have a configuration which is curved and directed toward a rear portion of the tag attaching pin controlling means 710 so that the predetermined angle $\alpha$ can be obtained.

The attachment 700 of the present invention comprises the tag attaching pin controlling means 710 and the connecting portion 503 each being integrally formed with each other and made of plastic material, metallic material or a composite material comprising the above-mentioned materials.

On at least one part of the first and the second supporting members 702 and 707 of the attachment 700, a connecting means is provided which can be fixedly coupled with and easily decoupled from either one of the first coupling means 703 or the second coupling means 705 that are provided at the at least one of the side wall surfaces 501 and 529 of the apparatus for attaching a tag-attaching pin 20.

It is preferable that the first coupling means 703 and 705 of the present invention are formed by a projecting portion or a recessed portion having a suitable height or a depth formed integrally with a surface of the side wall surface 501 or 529 of the apparatus 20. The planar configuration thereof can be one of a rectangular shape, a circular shape, a polygonal shape, an oval shape or the like.

The second coupling means reception portion 706 which is provided on the first and second supporting members 702 and 707 and which can be detachably coupled with the first and the second coupling means 703 and 705, respectively, preferably has a configuration that is substantially identical to that of the first and the second coupling means 703 and 705.

Further, in this embodiment, as explained above, the tag attaching pin controlling means 710 of the attachment 700 can be fixedly connected to the side wall surfaces 501 and 529 of the apparatus 20 and the top upper surface 504 thereof via the first supporting member 702 and the second supporting member 707 and the attaching/detaching operation supporting member 712.

It is also preferable that at the lower end portion of the tag attaching pin controlling means 710, an auxiliary supporting member 532, which has a configuration identical to the configuration having a slightly curved shape shown by the top upper surface of the apparatus for attaching a tag-attaching pin 20, is provided.

Further, at one of side edge portions of the auxiliary supporting member 532 of the tag attaching pin controlling means 710, for example, at a side edge portions thereof to which the base plate 511 of the tag attaching pin controlling means 710 is connected, a supporting plate 720 formed by a part of the base plate 511 which is extended downwardly therefrom and having a suitable length in downwardly direction, is preferably provided.

By using this supporting plate 720, the tag attaching pin controlling means 710 can be more fixedly connected to the top upper surface 504 of the apparatus 20.

Note that, it is a preferred embodiment that the auxiliary supporting member 532 is configured so that it can be detachably in tight contact with a top upper surface 504 of the apparatus 20.

Figure 22:
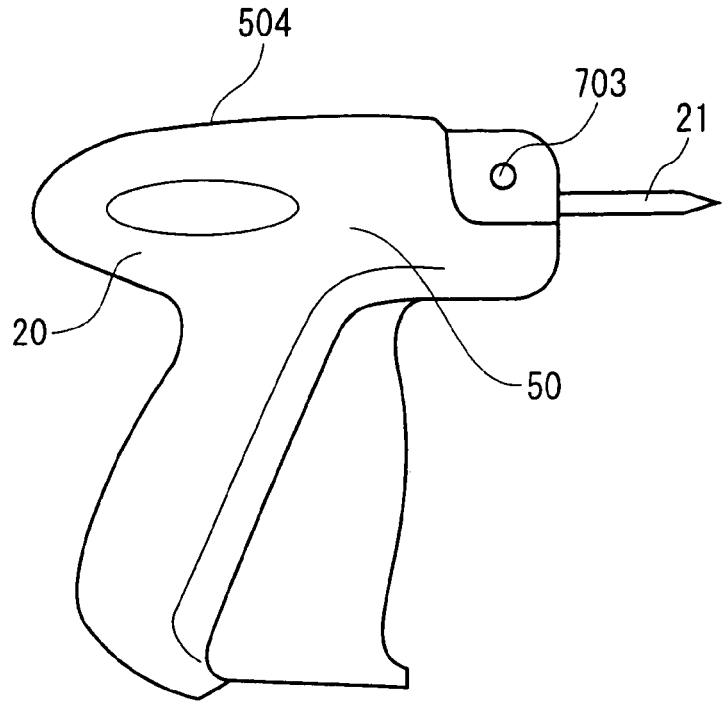
FIG. 22 is a side view showing a configuration of one embodiment of the apparatus for attaching a tag-attaching pin on which the attachment as shown in FIG. 20 is mounted.
Figure 22:
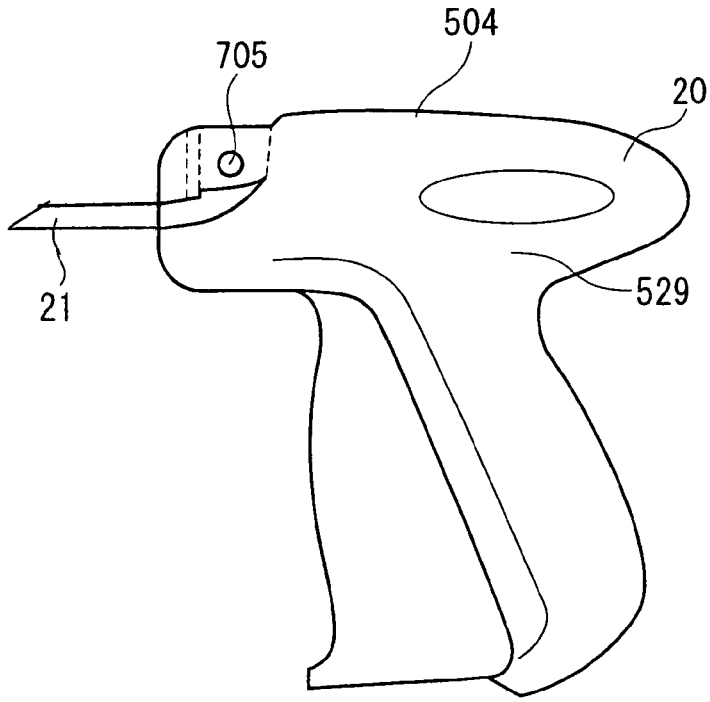
Figure 23:
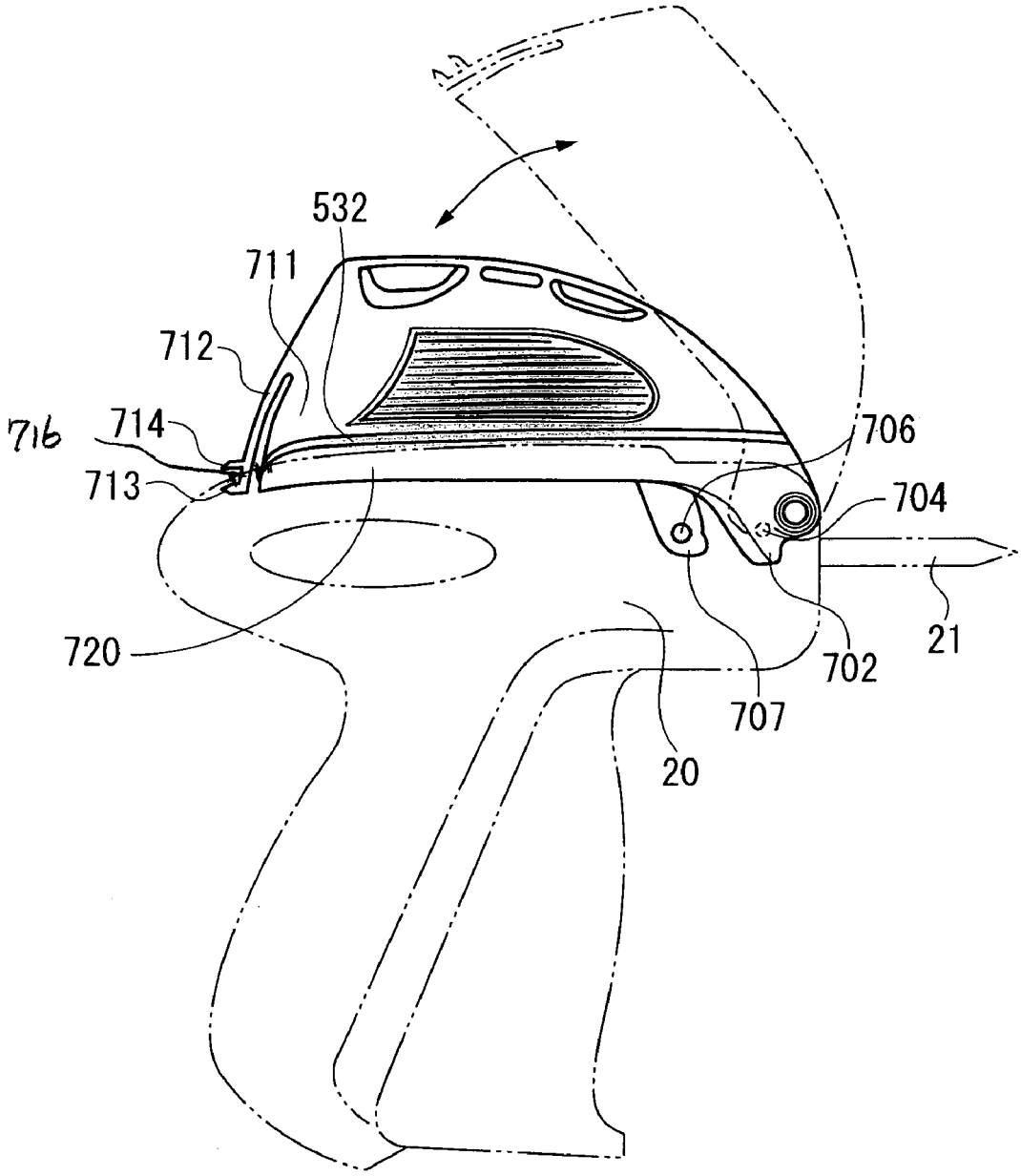
FIG. 23 is a drawing illustrating a condition in which a further separate embodiment of the attachment used in the present invention, is mounted on the apparatus.
Figure 24:
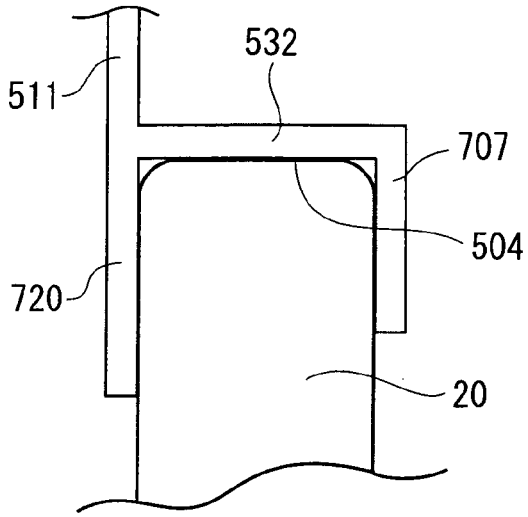
FIG. 24 is a cross-sectional view showing a part of a configuration of the further different embodiment of the attachment used in the present invention.
Figure 24:
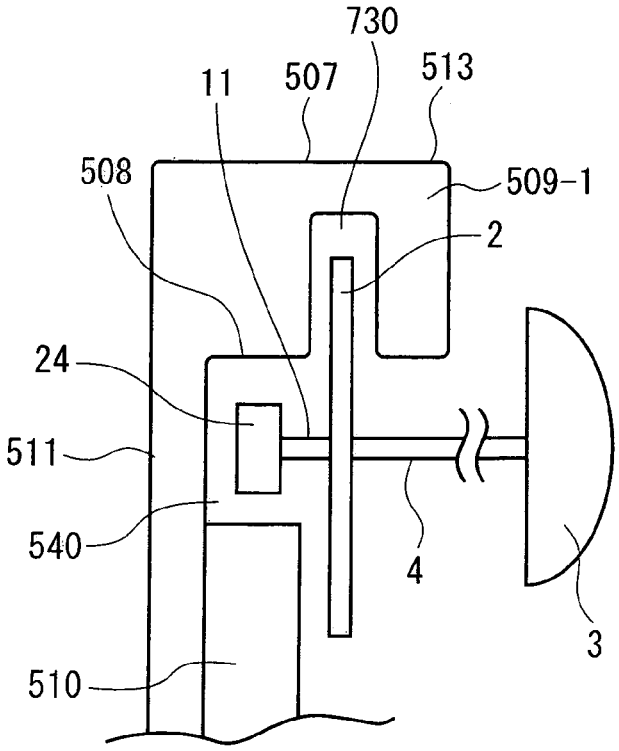
Figure 25:
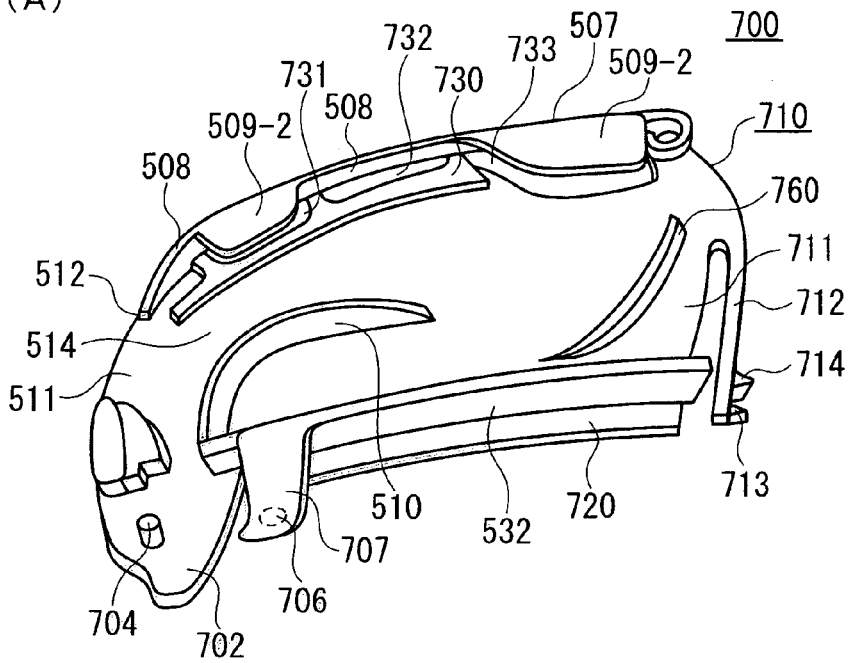
FIG. 25 is a schematic view showing a configuration of the further different embodiment of the attachment used in the present invention.
Figure 25:
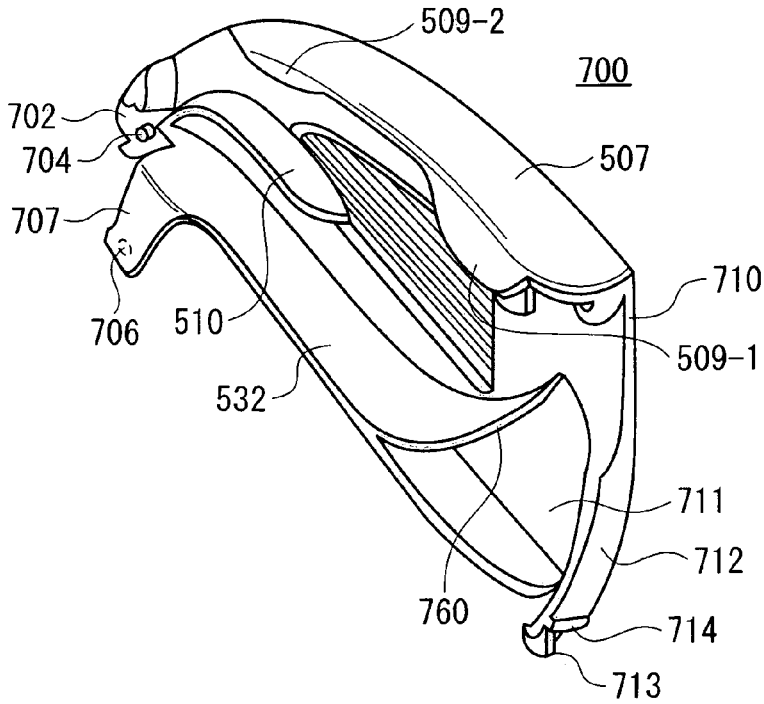
Figure 26:
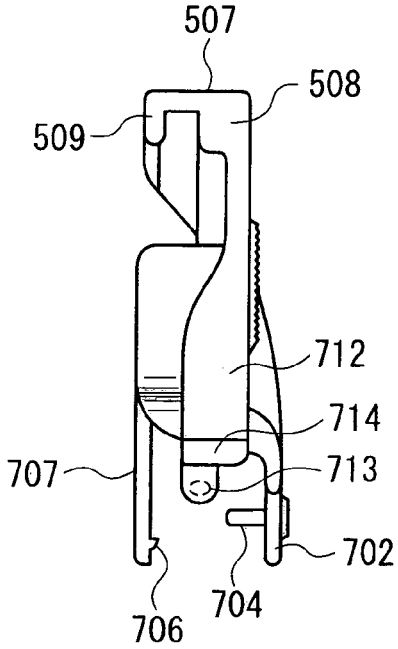
FIG. 26 (A) is a front view showing a configuration of the further different embodiment of the attachment used in the present invention and FIG. 26 (B) is a back-side view thereof.
Figure 26:
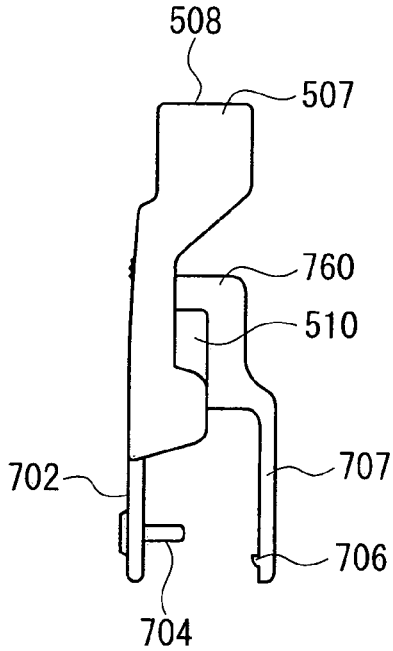
Figure 27:
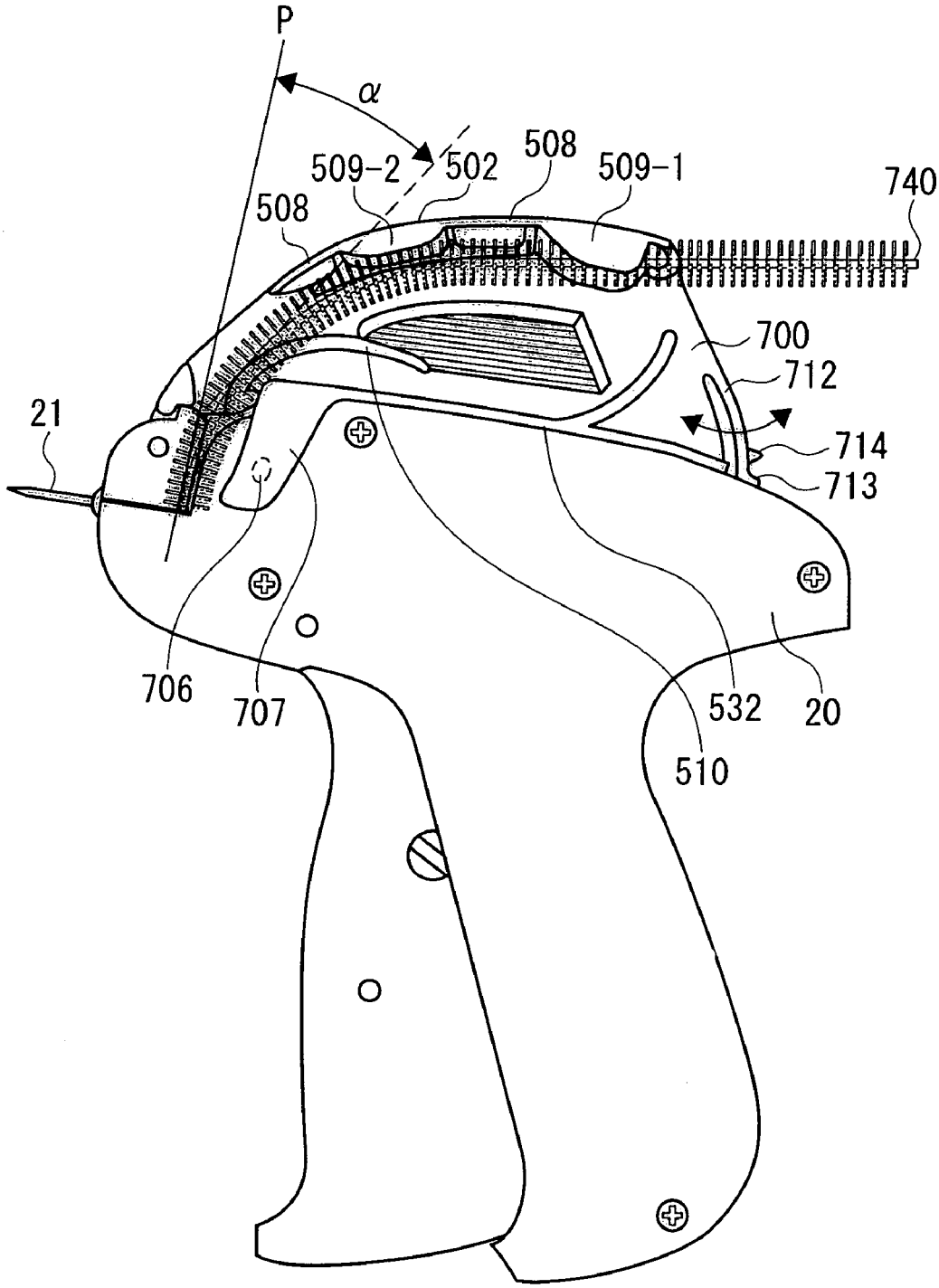
FIG. 27 is a side view illustrating an embodiment of usage of the further different embodiment of the attachment used in the present invention.

In order to attach the attachment 700 of this embodiment to the apparatus for attaching a tag-attaching pin 20, for example, first, after the projecting portion 704 forming the first coupling means reception portion and inside portion of the first supporting member 702 of the attachment 700, is inserted into a hole portion 703 forming the first coupling means and provided on a front end portion of the apparatus 20. This is so as to couple them with each other, by rotating the main body of the attachment 700 in a counter clockwise direction as shown in FIG. 22, and the second supporting member 707 is abutted to the second side wall surface 529 of the apparatus 20 and slid downwardly. At the same time the projecting portion 706 forming the second coupling means reception portion provided on the second supporting member 707 is engaged with the hole portion 705 forming the second coupling means provided on a part of the second side wall surface 529 of the apparatus 20.

Simultaneously, the fourth coupling means 713 formed at a tip end portion of the attaching/detaching operation supporting member 712 is provided at a rear end 711 of the attachment 700 and has resiliency. The tip end portion of the member 712 is inserted into the fourth coupling means reception portion 716 provided on the rear end portion of the top upper surface 504 of the apparatus 20 so that the fourth coupling means 713 and the fourth coupling means reception portion 716 are fixedly connected with each other. Thereby, the attaching operation to connect the attachment 700 to the apparatus 20 is completed.

On the other hand, when the attachment 700 is removed from the apparatus for attaching a tag-attaching pin 20, at first, an operator pushes an operating projection portion 714 provided on the attaching/detaching operation supporting member 712 to release the coupling condition between the fourth coupling means 713 and the fourth coupling means reception portion 716. Then, the operator picks up the overall tag attaching pin controlling means 710 upward and rotates it in a clockwise direction which is an opposite direction when it is attached to the apparatus 20. Thereby, the coupling condition formed between the second supporting member 707 and the second side wall surface 529 of the apparatus 20 is also released.

Finally, by releasing the coupling formed between the first supporting member 702 and the first coupling means 703 of the apparatus 20, the attachment 700 can be detached from the apparatus 20.

Further, the second supporting member 528 of this embodiment is preferably connected to a part of the free end portion of the auxiliary supporting member 532.

In a further separate embodiment of the present invention, an apparatus for attaching a tag-attaching pin 20 on which the attachment 500 or 700 as defined by the present invention is detachably connected.

In the present invention, an operator first picks up a sheet of tag-attaching pins 600 from a storing area and inserts the connecting bar 24 of the sheet 600 into the slit portions 40 and 41 provided on the apparatus 20.

Then the operator puts the connecting bar 24 of the sheet 600 into the guiding groove 540 of the tag attaching pin controlling means 710. After this operation, the operator starts the tag-attaching pin attaching operation with the apparatus 20.

In the present invention, a specific embodiment of the attachment 700 or 500 is preferably the one as shown in FIG. 5, when a sheet of tag-attaching pins 600 as shown in FIG. 12 is used and an apparatus 20 which is suitable for using this sheet 600 is used.

On the other hand, in a case in which a sheet of tag-attaching pins 600 as shown in FIG. 13 is used for shooting out each one of the tag-attaching pins 1 one by one with utilizing an apparatus for attaching a tag-attaching pin 20 as shown in FIG. 14, a specific embodiment to be used for this case, is not shown in the drawings but it would be a one in which the attachment 500 or 700 can be connected to a portion in the vicinity of the position at which the inserting section 13 is arranged and on one side wall surface of the apparatus 20, or can be connected to a portion in the vicinity of the position at which the socket section 15 is arranged and on an opposite side wall surface of the apparatus 20.

For shooting out each one of the tag-attaching pins 1 one by one by utilizing an apparatus for attaching a tag-attaching pin 20 as shown in FIG. 16, the attachment 700 is necessarily connected to the side wall surface of the apparatus 20 which is close to the position at which the inserting section 13 is arranged.

And further, in the present invention, when the apparatus for attaching a tag-attaching pin 20 is sold, the attachment 500 or 700 can be sold as a subordinate good of the apparatus 20, and thus both can be sold in a form of a set or the attachment 500 or 700 can be sold separately from the selling of the apparatus 20 as an optional good.

What is claimed is:

1. An attachment in combination with a sheet of tag-attaching pins and an apparatus using the sheet of tag-attaching pins, comprising:

said apparatus configured to receive said sheet of tag-attaching pins;

wherein said sheet of tag-attaching pins can be used for said apparatus in which said plurality of tag-attaching pins each comprise:

a filament section, an inserting head section provided at one end of said filament section, and a holding section provided at another end of said filament section;

said plurality of tag-attaching pins being mutually arranged in a parallel configuration and at least said inserting head section or a portion in the vicinity of said inserting head section or at least said holding section or a portion in the vicinity of said holding section of each one of said tag-attaching pins thereof, and being connected to connecting bars so that said parallel configuration of said sheet of tag-attaching pins can be maintained;

wherein a tag is attached to a desired good with said holding section by inserting said inserting head section of said tag-attaching pin into a hollow needle provided on said tag attaching device and by penetrating said needle and said inserting head section through said good and thereafter by pushing said inserting head section out of said hollow needle utilizing a predetermined pin pushing means, so as to have said inserting section attached to a back surface of said good while having said holding portion located on a front surface of said good with said tag;

and further wherein, said attachment includes:

an auxiliary supporting member which is configured so as to be closely attached to a top upper surface of said apparatus for attaching a tag-attaching pin over a predetermined length thereof and which has a predetermined width and a configuration showing a slightly curved shape similar to that of said top upper surface thereof;

a first supporting member which is integrally extended to a direction facing a tip end portion of said apparatus at which said hollow needle is provided, from one side edge portion of one end portion of said auxiliary supporting member which is located in the vicinity of said tip end portion of said apparatus, and further integrally extended downward from a level corresponding to said auxiliary supporting member and said first supporting member being detachably and pivotally connected to a first coupling means provided on a first side wall surface of said apparatus and at a position located in the vicinity of said tip end portion of said apparatus;

a tag attaching pin controlling means which is integrally extended upward from said first supporting member so as to form a single flat surface and also being integrally extended upward from over all of one side edge portion of said auxiliary supporting member with a predetermined height;

a second supporting member which is integrally extended downward from a position provided on another side edge portion of said auxiliary supporting member and which locates a portion not being overlapped with a position at which said first supporting member is provided on said opposite side edge portion thereof but in the vicinity of said tip end portion of said apparatus, and said second supporting member is detachably connected to a second coupling means provided on a second side wall surface of said apparatus;

a first guide wall portion which is arranged along an outer peripheral edge portion of said tag attaching pin controlling means and which serves to control a locus configuration of said connecting bar of said sheet of tag-attaching pins;

a second guide wall portion which is integrally extended upward with a curved configuration along a surface of said tag attaching pin controlling means from said one end portion of said auxiliary supporting member and which is located in the vicinity of said tip end portion of said apparatus and wherein said second guide wall portion is arranged so that at least a part thereof is opposed to a part of said first guide wall portion; and a third supporting member configured to attach or detach said tag attaching pin controlling means to or from the apparatus, provided at a rear portion of said tag attaching pin controlling means and wherein said third supporting member is integrally connected to said tag attaching pin controlling means via a slit portion and further wherein said third supporting member is further provided with a third coupling means which can be coupled with a suitable reception means provided on said top upper surface of said apparatus, on a free tip end portion thereof.

2. An attachment according to claim 1, wherein said second supporting member is configured so as to have a bias force which can press said second supporting member at said second side wall surface of said apparatus.

3. An attachment according to claim 1 or 2, wherein at least one of said first to third coupling means comprises a portion selected from a group of portions comprising a projecting portion, a recessed portion and a hole portion which can be coupled with either one of a projecting portion, a recessed portion and a hole portion each being provided on said side wall surfaces of said apparatus and on said top upper surface thereof.

4. An attachment according to claim 1 or 2, wherein at least a hole portion is provided on a part of said tag attaching pin controlling means.

* * * * *